US012529131B2

(12) United States Patent
Endoh et al.

(10) Patent No.: US 12,529,131 B2
(45) **Date of Patent: *Jan. 20, 2026**

(54) HIGH-STRENGTH GALVANIZED STEEL SHEET AND METHOD FOR MANUFACTURING THE SAME

(71) Applicant: JFE Steel Corporation, Tokyo (JP)

(72) Inventors: Kazuki Endoh, Tokyo (JP); Yoshiyasu Kawasaki, Tokyo (JP); Yuki Toji, Tokyo (JP); Yoshimasa Funakawa, Tokyo (JP); Mai Aoyama, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 700 days.

This patent is subject to a terminal disclaimer.

(21) Appl. No.: 17/791,322

(22) PCT Filed: Jan. 10, 2020

(86) PCT No.: PCT/JP2020/000727

§ 371 (c)(1),
(2) Date: Jul. 7, 2022

(87) PCT Pub. No.: WO2021/140663

PCT Pub. Date: Jul. 15, 2021

(65) Prior Publication Data

US 2024/0026477 A1 Jan. 25, 2024

(51) Int. Cl.

| | |
|---|---|
| ***C23C 2/28*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |

(52) U.S. Cl.

CPC ..... *C23C 2/28* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/02* (2013.01); *C22C 38/06* (2013.01); *C23C 2/29* (2022.08); *C21D 2211/001* (2013.01); *C21D 2211/005* (2013.01); *C21D 2211/008* (2013.01)

(58) Field of Classification Search

CPC .. C23C 2/28; C23C 2/29; C23C 30/00; C23C 2/022; C23C 2/06; C21D 8/0205; C21D 8/0226; C21D 8/0236; C21D 8/0263; C21D 2211/001; C21D 2211/005; C21D 2211/008; C21D 1/185; C21D 1/25; C21D 1/19; C21D 1/26; C21D 1/78; C21D 1/785; C21D 3/06; C21D 6/005; C21D 8/0257; C21D 8/0273; C21D 8/0405; C21D 8/0426; C21D 8/0436; C21D 8/0457; C21D 8/0463; C21D 8/0473; C21D 9/48; C21D 9/46; C22C 38/001; C22C 38/002; C22C 38/02; C22C 38/06; C22C 38/005; C22C 38/008; C22C 38/04; C22C 38/08; C22C 38/12; C22C 38/16; C22C 38/38; C22C 38/14; C22C 38/60; C22C 38/42; C22C 38/44; C22C 38/58; B32B 15/013; B21C 47/02

See application file for complete search history.

(56) References Cited

U.S. PATENT DOCUMENTS

| | | | | |
|---|---|---|---|---|
| 9,896,751 | B2 | 2/2018 | Kawata et al. | |
| 10,662,496 | B2 * | 5/2020 | Kawasaki | C22C 38/002 |
| 11,332,804 | B2 * | 5/2022 | Tsuchihashi | C22C 38/105 |
| 11,401,569 | B2 * | 8/2022 | Tsuchihashi | C22C 38/16 |
| 11,661,642 | B2 * | 5/2023 | Endo | C21D 8/0263 148/337 |
| 11,788,163 | B2 * | 10/2023 | Endo | C23C 2/0224 148/537 |
| 11,814,708 | B2 * | 11/2023 | Yokoyama | C22C 38/005 |
| 11,905,570 | B2 * | 2/2024 | Yokoyama | C21D 9/46 |
| 2013/0133792 | A1 | 5/2013 | Nakagaito et al. | |
| 2013/0330226 | A1 | 12/2013 | Murakami et al. | |
| 2014/0242414 | A1 | 8/2014 | Minami et al. | |
| 2014/0242416 | A1 | 8/2014 | Matsuda et al. | |
| 2015/0034218 | A1 | 2/2015 | Krizan et al. | |

(Continued)

FOREIGN PATENT DOCUMENTS

| | | |
|---|---|---|
| EP | 2 738 276 A1 | 6/2014 |
| EP | 2 765 212 A1 | 8/2014 |

(Continued)

OTHER PUBLICATIONS

Extended European Search Report for European Application No. 20911711.8, dated Nov. 23, 2022, 10 pages.

International Search Report and Written Opinion for International Application No. PCT/JP2020/000727, dated Apr. 7, 2020, 5 pages.

Office Action (Request for the Submission of an Opinion) issued Jul. 24, 2024, by the Intellectual Property Office in corresponding Korean Patent Application No. 10-2022-7023315 and an English translation of the Office Action. (12 pages).

Office Action (Notice of Final Rejection) issued Apr. 2, 2025, by the Korean Intellectual Property Office in corresponding Korean Patent Application No. 10-2022-7023315 and an English translation with Concise Statement of Relevance of the Office Action. (9 pages).

(Continued)

*Primary Examiner* — John A Hevey

(74) *Attorney, Agent, or Firm* — Buchanan Ingersoll & Rooney PC

(57) ABSTRACT

A high-strength galvanized steel sheet is disclosed which has a specified chemical composition, has a steel microstructure including, in terms of area fraction, 35% or more and 80% or less of ferrite, 0.1% or more and less than 5.0% of as-quenched martensite, 3.0% or more and 35% or less of tempered martensite, and 8% or more of retained austenite, in which an average grain diameter of the ferrite is 6 μm or less, in which an average grain diameter of the retained austenite is 3 μm or less, in which a value calculated by dividing an average Mn content (mass %) in the retained austenite by an average Mn content (mass %) in the ferrite is 1.5 or more.

20 Claims, No Drawings

(56) References Cited

U.S. PATENT DOCUMENTS

| | | | | |
|---|---|---|---|---|
| 2017/0218472 | A1* | 8/2017 | Kawasaki | C21D 8/0278 |
| 2018/0002800 | A1 | 1/2018 | Hasegawa et al. | |
| 2019/0211427 | A1* | 7/2019 | Sano | C22C 38/14 |
| 2020/0032364 | A1* | 1/2020 | Hirashima | C21D 8/0226 |
| 2021/0010101 | A1 | 1/2021 | Endo et al. | |
| 2021/0155999 | A1 | 5/2021 | Yokoyama et al. | |
| 2022/0186334 | A1* | 6/2022 | Endoh | B21C 47/02 |

FOREIGN PATENT DOCUMENTS

| | | | | |
|---|---|---|---|---|
| EP | 3 591 087 | A1 | 1/2020 | |
| EP | 3733898 | A1 | 11/2020 | |
| JP | 61157625 | A | 7/1986 | |
| JP | 01259120 | A | 10/1989 | |
| JP | 2003138345 | A | 5/2003 | |
| JP | 6123966 | B1 | 5/2017 | |
| JP | 2018-178247 | A | 11/2018 | |
| KR | 10-2017-0086654 | A | 7/2017 | |
| WO | 2013/051238 | A1 | 4/2013 | |
| WO | WO-2018146828 | A1 * | 8/2018 | B32B 15/012 |
| WO | 2019131189 | A1 | 7/2019 | |
| WO | 2019188642 | A1 | 10/2019 | |
| WO | 2019188643 | A1 | 10/2019 | |
| WO | 2019212045 | A1 | 11/2019 | |

OTHER PUBLICATIONS

Office Action issued by the U.S. Patent and Trademark Office in the U.S. Appl. No. 15/326,116, mailed Dec. 28, 2018, U.S. Patent and Trademark Office, Alexandria, VA. (19 pages).

Office Action issued by the U.S. Patent and Trademark Office in the U.S. Appl. No. 15/326,116, mailed Aug. 22, 2019, U.S. Patent and Trademark Office, Alexandria, VA. (8 pages).

Office Action issued by the U.S. Patent and Trademark Office in the U.S. Appl. No. 17/433,875, mailed Oct. 10, 2024, U.S. Patent and Trademark Office, Alexandria, VA. (11 pages).

Office Action issued by the U.S. Patent and Trademark Office in the U.S. Appl. No. 17/433,875, mailed Jan. 31, 2025, U.S. Patent and Trademark Office, Alexandria, VA. (11 pages),.

* cited by examiner

HIGH-STRENGTH GALVANIZED STEEL SHEET AND METHOD FOR MANUFACTURING THE SAME

CROSS REFERENCE TO RELATED APPLICATIONS

This is the U.S. National Phase application of PCT/JP2020/000727, filed Jan. 10, 2020, the disclosure of this application being incorporated herein by reference in its entirety for all purposes.

FIELD OF THE INVENTION

The present invention relates to a high-strength galvanized steel sheet which can preferably be used as a material for members in industrial fields such as automotive and electrical industrial fields and which is excellent in terms of formability and relates to a method for manufacturing the steel sheet. In particular, aspects of the present invention are intended to obtain a high-strength galvanized steel sheet which has a TS (tensile strength) of 980 MPa or more and which is excellent not only in terms of ductility but also in terms of stretch flangeability and bendability.

BACKGROUND OF THE INVENTION

Nowadays, from the viewpoint of global environment conservation, an increase in the fuel efficiency of automobiles is an important issue to be addressed. Therefore, there is an active trend toward increasing the strength of materials for automobile bodies to decrease the thickness of materials, thereby decreasing the weight of automobile bodies. However, since an increase in the strength of a steel sheet causes a deterioration in formability, there is a demand for the development of a material having not only high strength but also high formability. Moreover, when a steel sheet having a TS of 980 MPa or more is used as a material for the skeleton members of an automobile, the steel sheet is required to have, in addition to high formability, a high YR (yield ratio) to protect the occupants.

As a steel sheet which is excellent not only in terms of high strength but also in terms of high ductility, a high strength steel sheet utilizing the strain-induced transformation of retained austenite has been proposed. Since such a steel sheet has a steel microstructure including retained austenite, it is possible to easily form the steel sheet due to retained austenite when forming is performed, and it is possible to achieve high strength due to retained austenite transforming into martensite after forming has been performed.

For example, Patent Literature 1 proposes a high strength steel sheet having significantly high ductility which contains Mn in an amount of 0.2 weight % to 2.5 weight %, which has a tensile strength of 1000 MPa or more and an EL (total elongation) of 30% or more, and which utilizes the strain-induced transformation of retained austenite. Such a steel sheet is manufactured by forming austenite in a steel sheet containing C, Si, and Mn as basic constituents and by thereafter performing a so-called austempering treatment, in which the steel sheet is subjected to quenching and isothermal holding in a temperature range for bainite transformation. In this austempering treatment, retained austenite is formed due to an increase in the C concentration in austenite, and a large amount of C of more than 0.3% is necessary to form a large amount of retained austenite. However, in the case where the C concentration in steel is high, there is a deterioration in spot weldability, and, in particular, there is a marked deterioration in spot weldability in the case where the C concentration is more than 0.3%, which results in difficulty in using the steel sheet practically for an automobile. In addition, since the main object of Patent Literature 1 is to improve the ductility of a high strength steel sheet, no consideration is given to stretch flangeability or bendability.

In Patent Literature 2, by performing a heat treatment in a temperature range for forming a ferrite-austenite dual phase on steel containing Mn in an amount of 4 weight % to 6 weight %, a high level of strength-ductility balance is achieved. However, in the case of Patent Literature 2, since no consideration is given to an improvement in ductility due to an increase in the Mn concentration in untransformed austenite, there is room for improvement in workability.

In addition, in Patent Literature 3, by performing a heat treatment in a ferrite-austenite dual phase region on steel containing Mn in an amount of 3.0 mass % to 7.0 mass % to increase the Mn concentration in untransformed austenite, stable retained austenite is formed, thereby improving total elongation. However, since the heat treatment time is short, an insufficient increase in the Mn concentration due to the low diffusion rate of Mn is inferred.

Moreover, in Patent Literature 4, by performing heat treatment, for a long time, in a ferrite-austenite dual phase region on a hot-rolled steel sheet containing Mn in an amount of 0.50 mass % to 12.00 mass % to increase the Mn concentration in untransformed austenite, retained austenite having a large aspect ratio is formed, which results in an improvement in uniform elongation and stretch flangeability. However, in Patent Literature 4, consideration is given only to an improvement in the ductility and stretch flangeability of a high strength steel sheet, and no consideration is given to an improvement in stretch flangeability or bendability through the control of dispersion conditions in a second phase including retained austenite and martensite.

PATENT LITERATURE

PTL 1: Japanese Unexamined Patent Application Publication No. 61-157625

PTL 2: Japanese Unexamined Patent Application Publication No. 1-259120

PTL 3: Japanese Unexamined Patent Application Publication No. 2003-138345

PTL 4: Japanese Patent No. 6123966

SUMMARY OF THE INVENTION

Aspects of the present invention have been completed in view of the situation described above, and an object according to aspects of the present invention is to provide a high-strength galvanized steel sheet which has a TS (tensile strength) of 980 MPa or more and which is excellent in terms of formability and a method for manufacturing the steel sheet. Here, the meaning of "formability" includes ductility, stretch flangeability, and bendability.

To solve the problems described above, the present inventors diligently conducted investigations from the viewpoints of the chemical composition of a steel sheet and a method for manufacturing the steel sheet and, as a result, found the following.

The chemical composition of a steel material is controlled to contain Mn in an amount of 2.50 mass % or more and 8.00 mass % or less with the contents of other alloy elements such as Ti being appropriately controlled as needed, the steel material is subjected to hot rolling, the hot-rolled steel sheet is held in a temperature range equal to or lower than the $Ac_1$ transformation temperature for more than 1800 s as needed, and a pickling treatment is then performed as needed. Then, cold rolling is performed, the cold-rolled steel sheet is held in a temperature range equal to or higher than the $Ac_3$ transformation temperature for 20 s to 1800 s, the held steel sheet is cooled to a temperature of 50° C. or higher and 350° C. or lower, the cooled steel sheet is held at the cooling stop temperature for 2 s to 600 s, the held steel sheet is cooled, and a pickling treatment is then performed as needed. Subsequently, the steel sheet is held in a temperature range equal to or higher than the $Ac_1$ transformation temperature and equal to or lower than ($Ac_1$ transformation temperature+150° C.) for 20 s to 1800 s, the held steel sheet is cooled, and a pickling treatment is then performed as needed. Subsequently, the steel sheet is preferably held in a temperature range equal to or higher than the $Ac_1$ transformation temperature and equal to or lower than ($Ac_1$ transformation temperature+150° C.) for 20 s to 1800 s, the held steel sheet is cooled, and a galvanizing treatment is then performed. Optionally, the galvanized steel sheet is subjected to an alloying treatment at a temperature of 450° C. to 600° C., the steel sheet is then held in a temperature range of 50° C. or higher and 400° C. or lower for 1800 s or more, and the held steel sheet is cooled. As a result, it was found that it is possible to manufacture a high-strength galvanized steel sheet having a steel microstructure including, in terms of area fraction, 35% or more and 80% or less of ferrite, 0.1% or more and less than 5.0% of as-quenched martensite, 3.0% or more and 35% or less of tempered martensite, and 8% or more of retained austenite, in which the average grain diameter of the ferrite is 6 μm or less, in which the average grain diameter of the retained austenite is 3 μm or less, in which a value calculated by dividing the average Mn content (mass %) in the retained austenite by the average Mn content (mass %) in the ferrite is 1.5 or more, in which a value calculated by dividing the sum of the area fraction of tempered martensite having a circle-equivalent grain diameter of 3 μm or less and the area fraction of retained austenite having a circle-equivalent grain diameter of 3 μm or less by the sum of the area fraction of all the tempered martensite and the area fraction of all the retained austenite is 0.4 or more, and in which a value calculated by dividing the area fraction of retained austenite grains adjacent to three or more ferrite grains having different crystal orientations by the area fraction of all the retained austenite is less than 0.6, and a diffusible hydrogen content in steel of 0.3 mass ppm or less.

Aspects of the present invention have been completed on the basis of the knowledge described above, and the subject matter of aspects of the present invention is as follows.

[1] A high-strength galvanized steel sheet having a chemical composition containing, by mass %, C: 0.030% to 0.250%, Si: 0.01% to 3.00%, Mn: 2.50% to 8.00%, P: 0.001% to 0.100%, S: 0.0001% to 0.0200%, N: 0.0005% to 0.0100%, Al: 0.001% to 2.000%, and a balance of Fe and incidental impurities, a steel microstructure including, in terms of area fraction, 35% or more and 80% or less of ferrite, 0.1% or more and less than 5.0% of as-quenched martensite, 3.0% or more and 35% or less of tempered martensite, and 8% or more of retained austenite, in which an average grain diameter of the ferrite is 6 μm or less, in which an average grain diameter of the retained austenite is 3 μm or less, in which a value calculated by dividing an average Mn content (mass %) in the retained austenite by an average Mn content (mass %) in the ferrite is 1.5 or more, in which a value calculated by dividing a sum of an area fraction of tempered martensite having a circle-equivalent grain diameter of 3 μm or less and an area fraction of retained austenite having a circle-equivalent grain diameter of 3 μm or less by a sum of an area fraction of all the tempered martensite and an area fraction of all the retained austenite is 0.4 or more, and in which a value calculated by dividing an area fraction of retained austenite grains adjacent to three or more ferrite grains having different crystal orientations by the area fraction of all the retained austenite is less than 0.6, a galvanizing layer on a surface of the steel sheet, and a diffusible hydrogen content in steel of 0.3 mass ppm or less.

[2] The high-strength galvanized steel sheet according to item [1], in which the chemical composition further contains, by mass %, at least one selected from Ti: 0.005% to 0.200%, Nb: 0.005% to 0.200%, V: 0.005% to 0.500%, W: 0.005% to 0.500%, B: 0.0003% to 0.0050%, Ni: 0.005% to 1.000%, Cr: 0.005% to 1.000%, Mo: 0.005% to 1.000%, Cu: 0.005% to 1.000%, Sn: 0.002% to 0.200%, Sb: 0.002% to 0.200%, Ta: 0.001% to 0.100%, Ca: 0.0005% to 0.0050%, Mg: 0.0005% to 0.0050%, Zr: 0.0005% to 0.0050% and REM: 0.0005% to 0.0050%.

[3] The high-strength galvanized steel sheet according to item [1] or [2], in which the galvanizing layer is a galvannealing layer.

[4] A method for manufacturing a high-strength galvanized steel sheet, the method including heating a steel slab having the chemical composition according to item [1] or [2], performing hot rolling on the heated slab with a finishing delivery temperature of 750° C. or higher and 1000° C. or lower, coiling the hot-rolled steel sheet at a temperature of 300° C. or higher and 750° C. or lower, performing cold rolling on the hot-rolled steel sheet, holding the cold-rolled steel sheet in a temperature range equal to or higher than an $Ac_3$ transformation temperature for 20 s to 1800 s, cooling the held steel sheet to a cooling stop temperature of 50° C. or higher and 350° C. or lower, holding the cooled steel sheet at the cooling stop temperature for 2 s to 600 s, cooling the held steel sheet, holding the cooled steel sheet in a temperature range equal to or higher than an $Ac_1$ transformation temperature and equal to or lower than ($Ac_1$ transformation temperature+150° C.) for 20 s to 1800 s, cooling the held steel sheet, performing a galvanizing treatment, holding the galvanized steel sheet in a temperature range of 50° C. or higher and 400° C. or lower for 1800 s or more, and cooling the held steel sheet.

[5] A method for manufacturing a high-strength galvanized steel sheet, the method including heating a steel slab having the chemical composition according to item [1] or [2], performing hot rolling on the heated slab with a finishing delivery temperature of 750° C. or higher and 1000° C. or lower, coiling the hot-rolled steel sheet at a temperature of 300° C. or higher and 750° C. or lower, performing cold rolling on the hot-rolled steel sheet, holding the cold-rolled steel sheet in a temperature range equal to or higher than an $Ac_3$ transformation temperature for 20 s to 1800 s, cooling the held steel sheet to a cooling stop temperature of 50° C. or higher and 350° C. or lower, holding the cooled steel sheet at the cooling stop temperature for 2 s to 600 s, cooling the held steel sheet, holding the cooled steel sheet in a temperature range equal to or higher than an $Ac_1$ transformation temperature and equal to or lower than ($Ac_1$ transformation temperature+150° C.) for 20 s to 1800 s, cooling the held steel sheet, again holding the cooled steel sheet in a temperature range equal to or higher than the $Ac_1$ transformation temperature and equal to or lower than ($Ac_1$ transformation temperature+150° C.) for 20 s to 1800 s, cooling the held steel sheet, performing a galvanizing treatment, holding the galvanized steel sheet in a temperature range of 50° C. or higher and 400° C. or lower for 1800 s or more, and cooling the held steel sheet.

[6] The method for manufacturing a high-strength galvanized steel sheet according to item [4] or [5], the method further including, after coiling has been performed, holding the steel sheet in a temperature range equal to or lower than the $Ac_1$ transformation temperature for more than 1800 s.

[7] The method for manufacturing a high-strength galvanized steel sheet according to any one of items 4 to 6, the method further including, after the galvanizing treatment has been performed, performing an alloying treatment at a temperature of 450° C. to 600° C.

According to aspects of the present invention, it is possible to obtain a high-strength galvanized steel sheet which has a TS (tensile strength) of 980 MPa or more and which is excellent in terms of formability, and in particular, not only in terms of ductility but also in terms of stretch flangeability and bendability. By using a high-strength galvanized steel sheet manufactured by using the manufacturing method according to aspects of the present invention for, for example, automobile structural members, it is possible to improve fuel efficiency due to a decrease in the weight of an automobile body, which has a significant utility value in the industry.

DETAILED DESCRIPTION OF EMBODIMENTS OF THE INVENTION

Hereafter, embodiments of the present invention will be specifically described. Here, "%" used when describing the contents of the constituents of a chemical composition denotes "mass %".

(1) The reasons why the chemical composition of steel is specified as described above in accordance with aspects of the present invention will be described.

C: 0.030% or More and 0.250% or Less

C is an element which is necessary to increase strength by forming phases such as martensite transformed in low temperature. In addition, C is an element which is effective for improving the ductility of steel by improving the stability of retained austenite. In the case where the C content is less than 0.030%, since it is difficult to achieve the desired area fraction of martensite, it is not possible to achieve the desired strength. In addition, since it is difficult to achieve a sufficient area fraction of retained austenite, it is not possible to achieve good ductility. On the other hand, in the case where the C content is excessive large and is more than 0.250%, since there is an excessive increase in the area fraction of hard martensite, there is an increase in the number of micro voids at the grain boundaries of martensite and crack propagation progresses when a hole expanding test is performed, which results in a deterioration in stretch flangeability. In addition, since there is a deterioration in the mechanical properties of a weld zone due to a significant increase in the hardness of the weld zone and a heat-affected zone (HAZ), there is a deterioration in spot weldability, arc weldability, and so forth. From such viewpoints, the C content is set to be 0.030% or more and 0.250% or less. It is preferable that the C content be 0.080% or more. It is preferable that the C content be 0.200% or less. Hereafter, the term "hard martensite" denotes as-quenched martensite (martensite in the quenched state).

Si: 0.01% or More and 3.00% or Less

Since Si improves the work hardenability of ferrite, Si is effective for achieving good ductility. Since there is a decrease in such an effect in the case where the Si content is less than 0.01%, the lower limit of the Si content is set to be 0.01%. However, in the case where the Si content is excessive large and is more than 3.00%, embrittlement occurs in steel, and there is a deterioration in surface quality due to, for example, the occurrence of red scale. Moreover, there is a deterioration in quality of coating. Therefore, the Si content is set to be 0.01% or more and 3.00% or less. It is preferable that the Si content be 0.20% or more. It is preferable that the Si content be 2.00% or less or more preferably less than 0.70%.

Mn: 2.50% or More and 8.00% or Less

Mn is a significantly important element in accordance with aspects of the present invention. Mn is an element which stabilizes retained austenite, which is effective for achieving good ductility, and which increases the strength of steel through solid solution strengthening. Such effects are realized in the case where the Mn content in steel is 2.50% or more. However, in the case where the Mn content is excessive large and is more than 8.00%, there is a deterioration in phosphatability and quality of coating. From such viewpoints, the Mn content is set to be 2.50% or more and 8.00% or less. It is preferable that the Mn content be 3.10% or more or more preferably 3.20% or more. It is preferable that the Mn content be 6.00% or less or more preferably 4.20% or less.

P: 0.001% or More and 0.100% or Less

P is an element which has a function of solid solution strengthening and which may be added in accordance with desired strength. In addition, P is an element which is effective for forming a multi-phase structure by promoting ferrite transformation. To realize such effects, it is necessary that the P content be 0.001% or more. On the other hand, in the case where the P content is more than 0.100%, there is a deterioration in weldability, and there is a deterioration in galvanizing layer quality due to a decrease in alloying rate when a galvanizing layer is subjected to an alloying treatment. Therefore, the P content is set to be 0.001% or more and 0.100% or less. It is preferable that the P content be 0.005% or more. It is preferable that the P content be 0.050% or less.

S: 0.0001% or More and 0.0200% or Less

S causes embrittlement to occur in steel when hot work is performed as a result of being segregated at grain boundaries and causes a deterioration in local deformability as a result of existing in the form of sulfides. Therefore, it is necessary that the S content be 0.0200% or less, preferably 0.0100% or less, or more preferably 0.0050% or less. However, due to constraints regarding manufacturing techniques, it is necessary that the S content be 0.0001% or more. Therefore, the S content is set to be 0.0001% or more and 0.0200% or less. It is preferable that the S content be 0.0001% or more and 0.0100% or less. It is more preferable that the S content be 0.0001% or more and 0.0050% or less.

N: 0.0005% or More and 0.0100% or Less

N is an element which causes a deterioration in the aging resistance of steel. In particular, in the case where the N content is more than 0.0100%, there is a marked deterioration in aging resistance. Although it is preferable that the N content be as small as possible, it is necessary that the N content be 0.0005% or more due to constraints regarding manufacturing techniques. Therefore, the N content is set to be 0.0005% or more and 0.0100% or less. It is preferable that the N content be 0.0010% or more. It is preferable that the N content be 0.0070% or less.

Al: 0.001% or More and 2.000% or Less

Al is an element which is effective for decreasing the annealing-temperature dependency of mechanical properties, that is, for stabilizing mechanical properties by expanding a range of intercritical annealing temperature of ferrite and austenite. Since there is a decrease in the effect of Al added in the case where the Al content is less than 0.001%, the lower limit of the Al content is set to be 0.001%. In addition, since Al is an element which is effective for increasing the cleanliness of steel by functioning as a deoxidizing agent, it is preferable that Al be added in a deoxidizing process. However, in the case where the Al content is large and is more than 2.000%, since there is an increased risk of a crack occurring in a steel slab when continuous casting is performed, there is a deterioration in manufacturability. From such viewpoints, the Al content is set to be 0.001% or more and 2.000% or less. It is preferable that the Al content be 0.020% or more. It is preferable that the Al content be 1.200% or less.

In addition, by mass %, at least one selected from Ti: 0.005% or more and 0.200% or less, Nb: 0.005% or more and 0.200% or less, V: 0.005% or more and 0.500% or less, W: 0.005% or more and 0.500% or less, B: 0.0003% or more and 0.0050% or less, Ni: 0.005% or more and 1.000% or less, Cr: 0.005% or more and 1.000% or less, Mo: 0.005% or more and 1.000% or less, Cu: 0.005% or more and 1.000% or less, Sn: 0.002% or more and 0.200% or less, Sb: 0.002% or more and 0.002% or less, Ta: 0.001% or more and 0.100% or less, Ca: 0.0005% or more and 0.0050% or less, Mg: 0.0005% or more and 0.0050% or less, Zr: 0.0005% or more and 0.0050% or less, and REM (abbreviation for rare earth metals): 0.0005% or more and 0.0050% or less may optionally be added in addition to the constituents described above.

Constituents other than those described above are Fe and incidental impurities. Here, in the case where one of the constituents described above is contained in an amount less than the lower limit of the content thereof, such a constituent is regarded as being contained as an incidental impurity.

Ti: 0.005% or More and 0.200% or Less

Since Ti is effective for increasing the strength of steel through precipitation strengthening, Ti decreases a difference in hardness between ferrite and a hard second phase (martensite or retained austenite) by increasing the strength of ferrite, thereby making it possible to achieve good stretch flangeability. It is possible to realize such an effect in the case where the Ti content is 0.005% or more. However, in the case where the Ti content is more than 0.200%, since there is an excessive increase in the area fraction of hard martensite, there is an increase in the number of micro voids at the grain boundaries of martensite and crack propagation progresses when a hole expanding test is performed, which may result in a deterioration in stretch flangeability and bendability. Therefore, in the case where Ti is added, the Ti content is set to be 0.005% or more and 0.200% or less. It is preferable that the Ti content be 0.010% or more. It is preferable that the Ti content be 0.100% or less.

Nb: 0.005% or More and 0.200% or Less, V: 0.005% or More and 0.500% or Less, and W: 0.005% or More and 0.500% or Less Nb, V, and W are effective for increasing the strength of steel through precipitation strengthening, and it is possible to realize such an effect in the case where the content of each of these elements is 0.005% or more. In addition, as in the case of the effect of Ti being added, these elements decrease a difference in hardness between ferrite and a hard second phase (martensite or retained austenite) by increasing the strength of ferrite, thereby making it possible to achieve good stretch flangeability. It is possible to realize such an effect in the case where the content of each of these elements is 0.005% or more. However, in the case where the Nb content is more than 0.200% or the V content or the W content is more than 0.500%, since there is an excessive increase in the area fraction of hard martensite, there is an increase in the number of micro voids at the grain boundaries of martensite and crack propagation progresses when a hole expanding test is performed, which may result in a deterioration in stretch flangeability. Therefore, in the case where Nb is added, the Nb content is set to be 0.005% or more and 0.200% or less. It is preferable that the Nb content be 0.010% or more. It is preferable that the Nb content be 0.100% or less. In the case where V is added, the V content is set to be 0.005% or more and 0.500% or less. It is preferable that the V content be 0.010% or more. It is preferable that the V content be 0.300% or less. In the case where W is added, the W content is set to be 0.005% or more and 0.500% or less. It is preferable that the W content be 0.010% or more. It is preferable that the W content be 0.300% or less.

B: 0.0003% or More and 0.0050% or Less

Since B has a function of inhibiting the nucleation and growth of ferrite from austenite grain boundaries, B decreases a difference in hardness between ferrite and a hard second phase (martensite or retained austenite) by increasing the strength of ferrite, thereby making it possible to achieve good stretch flangeability and bendability. It is possible to realize such an effect in the case where the B content is 0.0003% or more. However, in the case where the B content is more than 0.0050%, there may be a deterioration in formability. Therefore, in the case where B is added, the B content is set to be 0.0003% or more and 0.0050% or less. It is preferable that the B content be 0.0005% or more. It is preferable that the B content be 0.0030% or less.

Ni: 0.005% or More and 1.000% or Less

Ni is an element which stabilizes retained austenite, which is effective for achieving good ductility, and which increases the strength of steel through solid solution strengthening. It is possible to realize such an effect in the case where the Ni content is 0.005% or more. On the other hand, in the case where the Ni content is more than 1.000%, since there is an excessive increase in the area fraction of hard martensite, there is an increase in the number of micro voids at the grain boundaries of martensite and crack propagation progresses when a hole expanding test is performed, which may result in a deterioration in stretch flangeability. Therefore, in the case where Ni is added, the Ni content is set to be 0.005% or more and 1.000% or less. It is preferable that the Ni content be 0.010% or more. It is preferable that the Ni content be 0.500% or less.

Cr: 0.005% or More and 1.000% or Less and Mo: 0.005% or More and 1.000% or Less

Since Cr and Mo have a function of improving the strength-ductility balance, these elements may be added as needed. It is possible to realize such an effect in the case where the Cr content is 0.005% or more or the Mo content is 0.005% or more. However, in the case where the Cr content is excessively large and is more than 1.000% or the Mo content is excessively large and is more than 1.000%, since there is an excessive increase in the area fraction of hard martensite, there is an increase in the number of micro voids at the grain boundaries of martensite and crack propagation progresses when a hole expanding test is performed, which may result in a deterioration in stretch flangeability. Therefore, in the case where these elements are added, the Cr content is set to be 0.005% or more and 1.000% or less, and the Mo content is set to be 0.005% or more and 1.000% or less. It is preferable that the Cr content be 0.010% or more. It is preferable that the Cr content be 0.500% or less. It is preferable that the Mo content be 0.010% or more. It is preferable that the Mo content be 0.500% or less.

Cu: 0.005% or More and 1.000% or Less

Cu is an element which is effective for increasing the strength of steel. It is possible to realize such an effect in the case where the Cu content is 0.005% or more. On the other hand, in the case where the Cu content is more than 1.000%, since there is an excessive increase in the area fraction of hard martensite, there is an increase in the number of micro voids at the grain boundaries of martensite and crack propagation progresses when a hole expanding test is performed, which may result in a deterioration in stretch flangeability. Therefore, in the case where Cu is added, the Cu content is set to be 0.005% or more and 1.000% or less. It is preferable that the Cu content be 0.010% or more. It is preferable that the Cu content be 0.500% or less.

Sn: 0.002% or More and 0.200% or Less and Sb: 0.002% or More and 0.200% or Less

Sn and Sb are added as needed from the viewpoint of inhibiting decarburization in a region within about several tens of μm of the surface layer of the steel sheet due to the nitridation and oxidation of a steel sheet surface. In the case where the Sn content is 0.002% or more or the Sb content is 0.002% or more, it is possible to inhibit the nitridation and oxidation of the steel sheet surface, thereby preventing a decrease in the area fraction of martensite on the steel sheet surface, which is effective for achieving satisfactory strength and the stability of material quality. On the other hand, in the case where the Sn content or the Sb content is excessively large and is more than 0.200%, there is a deterioration in toughness. Therefore, in the case where Sn is added, the Sn content is set to be 0.002% or more and 0.200% or less. It is preferable that the Sn content be 0.004% or more. It is preferable that the Sn content be 0.050% or less. In the case where Sb is added, the Sb content is set to be 0.002% or more and 0.200% or less. It is preferable that the Sb content be 0.004% or more. It is preferable that the Sb content be 0.050% or less. Here, the term "martensite" denotes as-quenched martensite.

Ta: 0.001% or More and 0.100% or Less

Ta, like Ti and Nb, contributes to increasing strength by forming alloy carbides and alloy carbonitrides. In addition, it is considered that, since Ta is partially dissolved in Nb carbides and Nb carbonitrides to form complex precipitates such as (Nb, Ta) (C, N), Ta markedly inhibits coarsening of precipitates, thereby stabilizing the contribution to increasing strength through precipitation strengthening. Therefore, it is preferable that Ta be added. Here, it is possible to realize the above-described effect of stabilizing precipitates in the case where the Ta content is 0.001% or more. On the other hand, in the case where the Ta content is excessively large, the effect of stabilizing precipitates becomes saturated, and there is an increase in alloy cost. Therefore, in the case where Ta is added, the Ta content is set to be 0.001% or more and 0.100% or less. It is preferable that the Ta content be 0.005% or more. It is preferable that the Ta content be 0.050% or less.

Ca: 0.0005% or More and 0.0050% or Less, Mg: 0.0005% or More and 0.0050% or Less, Zr: 0.0005% or More and 0.0050% or Less, and REM: 0.0005% or More and 0.0050% or Less Ca, Mg, Zr, and REM are elements which are effective for further reducing the negative effect of sulfides on stretch flangeability through the spheroidizing of sulfides. To realize such an effect, it is preferable that the content of each of these elements be 0.0005% or more. However, in the case where the content of each of these elements is excessively large and is more than 0.0050%, there is an increase in the amount of, for example, inclusions, which results in surface and internal defects or the like. Therefore, in the case where Ca, Mg, Zr, and REM are added, the content of each of these elements is set to be 0.0005% or more and 0.0050% or less. It is preferable that the content of each of Ca, Mg, Zr, and REM be 0.0010% or more. It is preferable that the content of each of Ca, Mg, Zr, and REM be 0.0040% or less.

(2) Hereafter, the microstructure will be described.

Area Fraction of Ferrite: 35% or More and 80% or Less

To achieve satisfactory ductility, it is necessary that the area fraction of ferrite be 35% or more. In addition, to achieve a tensile strength of 980 MPa or more, it is necessary that the area fraction of soft ferrite be 80% or less. Here, the meaning of "ferrite" includes polygonal ferrite, granular ferrite, and acicular ferrite, which are kinds of ferrite that are comparatively soft and rich in terms of ductility. It is preferable that the area fraction of ferrite be 40% or more. It is preferable that the area fraction of ferrite be 75% or less.

Area Fraction of as-Quenched Martensite: 0.1% or More and Less than 5.0%

To achieve a TS of 980 MPa or more, it is necessary that the area fraction of as-quenched martensite be 0.1% or more. In addition, to achieve good ductility, it is necessary that the area fraction of as-quenched martensite be less than 5.0%. It is preferable that the area fraction of as-quenched martensite be 0.2% or less.

Area Fraction of Tempered Martensite: 3.0% or More and 35% or Less

To achieve high local elongation, good stretch flangeability, good bendability, and high yield ratio, it is necessary that the area fraction of tempered martensite be 3.0% or more. In addition, to achieve a TS of 980 MPa or more, it is necessary that the area fraction of tempered martensite be 35% or less. It is preferable that the area fraction of tempered martensite be 5.0% or more. It is preferable that the area fraction of tempered martensite be 20% or less.

Incidentally, a method for determining the area fractions of ferrite, as-quenched martensite, and tempered martensite is as follows. Such area fractions are determined by polishing a cross section (L-cross section) in the thickness direction parallel to the rolling direction of a steel sheet, by etching the polished cross section with a 3 vol. % nital solution, by observing 10 fields of view at a position located at ¼ of the thickness (position located at a distance of ¼ of the thickness from the steel sheet surface, where the distance is measured in the thickness direction) with a SEM (scanning electron microscope) at a magnification of 2000 times to obtain microstructure images, by analyzing the obtained microstructure images by using Image-Pro produced by Media Cybernetics, Inc. to calculate the area fraction of each of the phases (ferrite, as-quenched martensite, and tempered martensite) in each of the 10 fields of view, and by calculating the average area fraction of each of the phases from the area fractions of each of the phases in the 10 fields of view. In addition, in the microstructure image described above, ferrite is identified as a gray microstructure (base microstructure), as-quenched martensite is identified as a white microstructure, and tempered martensite is identified as a white martensite microstructure containing gray substructures.

Area Fraction of Retained Austenite: 8% or More

To achieve satisfactory ductility, it is necessary that the area fraction of retained austenite be 8% or more. It is preferable that the area fraction of retained austenite be 12% or more.

Here, the area fraction of retained austenite is defined as a volume fraction which is determined by polishing a steel sheet to a plane located 0.1 mm from a position located at ¼ of the thickness, by further performing chemical polishing on the polished surface to remove a thickness of 0.1 mm, by determining the integral intensity ratio of the diffraction peak of each of the {200}, {220}, and {311} of fcc (face centered cubic) iron and the {200}, {211}, and {220} of bcc (body centered cubic) iron of the exposed surface by using an X-ray diffractometer with CoKα-ray, and by calculating the average value of the obtained 9 integral intensity ratios to determine a volume fraction.

Average Grain Diameter of Ferrite: 6 μm or Less

A decrease in the grain diameter of ferrite contributes to an improvement in TS. Therefore, to achieve the desired TS, it is necessary that the average grain diameter of ferrite be 6 μm or less. It is preferable that the average grain diameter of ferrite be 5 μm or less. It is preferable that the lower limit of the average grain diameter of ferrite be 2 μm or more.

Average Grain Diameter of Retained Austenite: 3 μm or Less

A decrease in the grain diameter of retained austenite contributes to an improvement in ductility and an improvement in stretch flangeability. Therefore, to achieve good ductility and good stretch flangeability, it is necessary that the average grain diameter of retained austenite be 3 μm or less. It is preferable that the average grain diameter of retained austenite be 2.5 μm or less. It is preferable that the lower limit of the average grain diameter of retained austenite be 0.3 μm or more.

Value Calculated by Dividing Average Mn Content (Mass %) in Retained Austenite by Average Mn Content (Mass %) in Ferrite is 1.5 or More The requirement that a value calculated by dividing the average Mn content (mass %) in retained austenite by the average Mn content (mass %) in ferrite be 1.5 or more is a significantly important constituent feature in accordance with aspects of the present invention. To achieve good ductility, it is necessary that the area fraction of stable retained austenite in which Mn is concentrated be high. It is preferable that the value calculated by dividing the average Mn content (mass %) in retained austenite by the average Mn content (mass %) in ferrite be 2.0 or more. It is preferable that such a value be 4.0 or less.

It is possible to determine the Mn content in retained austenite and the Mn content in ferrite by quantifying Mn distribution in each of the phases in the cross section in the rolling direction at a position located at ¼ of the thickness by using an FE-EPMA (field emission-electron probe micro analyzer) and by calculating the average Mn content in randomly selected 30 retained austenite grains and the average Mn content in randomly selected 30 ferrite grains in the measurement field of view.

Value calculated by dividing sum of area fraction of tempered martensite having a circle-equivalent grain diameter of 3 μm or less and area fraction of retained austenite having a circle-equivalent grain diameter of 3 μm or less by sum of area fraction of all tempered martensite and area fraction of all retained austenite: 0.4 or more The requirement that a value calculated by dividing the sum of the area fraction of tempered martensite having a circle-equivalent grain diameter of 3 μm or less and the area fraction of retained austenite having a circle-equivalent grain diameter of 3 μm or less by the sum of the area fraction of all the tempered martensite and the area fraction of all the retained austenite be 0.4 or more is an important constituent feature in accordance with aspects of the present invention. A decrease in the grain diameters of tempered martensite and retained austenite contributes to an improvement in stretch flangeability. To achieve good stretch flangeability, while achieving sufficient area fractions of tempered martensite and retained austenite for achieving high strength and high ductility, it is necessary to increase the area fractions of fine tempered martensite and retained austenite. It is preferable that the value calculated by dividing the sum of the area fraction of tempered martensite having a circle-equivalent grain diameter of 3 μm or less and the area fraction of retained austenite having a circle-equivalent grain diameter of 3 μm or less by the sum of the area fraction of all the tempered martensite and the area fraction of all the retained austenite be 0.6 or more.

Here, the average grain diameters of ferrite, tempered martensite, and retained austenite are determined by obtaining the area of each of ferrite grains, tempered martensite grains, and retained austenite grains by using Image-Pro described above, by calculating circle-equivalent grain diameters, and by calculating the average circle-equivalent grain diameter of each of the phases. Tempered martensite and retained austenite are distinguished by using Phase Map of EBSD (electron backscattered diffraction).

Value calculated by dividing area fraction of retained austenite grains adjacent to three or more ferrite grains having different crystal orientations by area fraction of all retained austenite: less than 0.6

The requirement that a value calculated by dividing the area fraction of retained austenite grains adjacent to three or more ferrite grains having different crystal orientations, that is, retained austenite grains existing at the triple junctions of ferrite grain boundaries, by the area fraction of all the retained austenite be less than 0.6 is an important constituent feature in accordance with aspects of the present invention. A decrease in the number of ferrite grains which are adjacent to retained austenite grains and which have different crystal orientations causes the relax of stress concentration at the time of flange forming deformation and bending deformation, thereby contributing to an improvement in stretch flangeability and bendability. Therefore, to achieve good stretch flangeability, it is necessary that the area fraction of retained austenite grains adjacent to three or more ferrite grains having different crystal orientations be low. It is preferable that the value calculated by dividing the area fraction of retained austenite grains adjacent to three or more ferrite grains having different crystal orientations by the area fraction of all the retained austenite be less than 0.5.

Here, the crystal orientation of ferrite is determined by using Inverse Pole Figure Map of EBSD (electron backscattered diffraction). In addition, the expression "ferrite grains having different crystal orientations" denotes a case where ferrite grains have a misorientation of 1 degree or more in terms of Euler angle obtained by performing EBSD analysis. In addition, retained austenite grains adjacent to three or more ferrite grains having different crystal orientations are identified by using an IPF map obtained by performing EBSD analysis.

Diffusible Hydrogen Content in Steel: 0.3 Mass Ppm or Less

The requirement that the diffusible hydrogen content in steel be 0.3 mass ppm or less is an important constituent feature in accordance with aspects of the present invention. To achieve high local elongation and good stretch flangeability, it is necessary that the diffusible hydrogen content in steel be 0.3 mass ppm or less. It is preferable that the diffusible hydrogen content in steel be 0.2 mass ppm or less. Here, a steel material whose diffusible hydrogen content in steel is measured is not limited to a high-strength galvanized steel sheet which has not yet been subjected to work, and such a steel material may be a steel sheet which has been subjected to punching followed by work such as stretch flange forming and bending work or may be a fabricated part which is manufactured by further welding the steel sheets which has been subjected to such work. Here, a method for measuring the diffusible hydrogen content in steel is as follows. After having performed grinding to remove the coating layer of a test specimen having a length of 30 mm and a width of 5 mm which has been taken from a steel sheet, the diffusible hydrogen content in steel and the emission peak of diffusible hydrogen are measured. The emission peak is measured by using thermal desorption spectrometry (TDS) at a heating rate of 200° C./hr. Here, hydrogen detected in a temperature range of 300° C. or lower is defined as diffusible hydrogen.

In addition, it is preferable that a value calculated by dividing the area fraction of blocky austenite by the sum of the area fraction of lath-shaped austenite and the area fraction of blocky austenite be less than 0.6. In the case where the area fraction of blocky austenite is excessively large, there may be a deterioration in the local elongation and stretch flangeability of steel. Therefore, to achieve a higher level of local elongation and good stretch flangeability, it is preferable that a value calculated by dividing the area fraction of blocky austenite by the sum of the area fraction of lath-shaped austenite and the area fraction of blocky austenite be less than 0.6. It is more preferable that a value calculated by dividing the area fraction of blocky austenite by the sum of the area fraction of lath-shaped austenite and the area fraction of blocky austenite be less than 0.4. The term "blocky austenite" denotes an austenite grain having an aspect ratio between major and minor axes of less than 2.0, and the term "lath-shaped austenite" denotes an austenite grain having an aspect ratio between major and minor axes of 2.0 or more. Here, the aspect ratio of retained austenite is calculated by drawing an ellipse circumscribed around the retained austenite grain by using Photoshop elements 13 and by dividing the length of the major axis of the ellipse by the length of the minor axis of the ellipse.

Even in the case where, in addition to ferrite, martensite, tempered martensite, and retained austenite, carbides such as bainite, pearlite, cementite, and the like are included in a total amount of 10% or less in terms of area fraction in the microstructure according to aspects of the present invention, there is no decrease in the effects according to aspects of the present invention.

(3) Hereafter, the manufacturing conditions will be described.

Steel Slab Heating Temperature

Although there is no particular limitation on the heating temperature of a steel slab, it is preferable that the heating temperature be 1100° C. or higher and 1300° C. or lower. Since precipitates existing in the steel slab heating stage exist in the form of coarse precipitates in a finally obtained steel sheet, such precipitates do not contribute to strength. By heating the steel slab, it is possible to re-dissolve Ti- and Nb-based precipitates or the like which are precipitated when casting is performed. As a result, since there is a decrease in the amount of coarse precipitates, and since there is an increase in the amount of fine precipitates which contribute to an increase in strength, it is possible to realize the precipitation strengthening of finally-obtained steel, which results in an improvement in the strength of a steel sheet. Moreover, from the viewpoint of removing blowholes, segregated materials, and so forth in the surface layer of the steel slab to decrease the number of cracks and unevenness on the steel sheet surface and thereby achieving a higher level of smooth steel sheet surface, it is preferable that the steel slab heating temperature be 1100° C. or higher. On the other hand, from the viewpoint of inhibiting an increase in the amount of scale loss due to an increase in the amount of oxidation, it is preferable that the steel slab heating temperature be 1300° C. or lower.

It is more preferable that the steel slab heating temperature be 1150° C. or higher. It is more preferable that the steel slab heating temperature be 1250° C. or lower.

Although it is preferable that a steel slab be manufactured by using a continuous casting method from the viewpoint of preventing macro segregation, for example, an ingot casting or a thin-slab casting method may be used for manufacturing a steel slab. In addition, instead of a conventional method, in which, after having manufactured a steel slab, the slab is first cooled to room temperature and then reheated, an energy-saving process may be used without causing any problem. Examples of the energy-saving process include a hot charge rolling process, in which the slab in the hot state is charged into a heating furnace without being cooled to room temperature and then subjected to hot rolling, and a hot direct rolling process, in which the slab is rolled immediately after heat retention has been performed for a short time. In addition, a steel slab is made into a sheet bar by performing rough rolling under ordinary conditions, and, in the case where a heating temperature is comparatively low, it is preferable that the sheet bar be heated by using, for example, a bar heater before finish rolling is performed from the viewpoint of preventing problems from occurring when hot rolling is performed.

Finishing Delivery Temperature of Hot Rolling: 750° C. or Higher and 1000° C. or Lower The steel slab which has been subjected to heating is subjected to hot rolling through a rough rolling process and a finish rolling process so that a hot-rolled steel sheet is obtained. At this time, in the case where the finishing delivery temperature is higher than 1000° C., since there is a sharp increase in the amount of oxides (scale) generated, the interface between the base steel and the oxides is roughened, which results in a tendency for the surface quality to be deteriorated after pickling and cold rolling have been performed. In addition, in the case where, for example, hot rolling scale is partially left unremoved after pickling has been performed, there is a negative effect on ductility and stretch flangeability. Moreover, since there is an excessive increase in grain diameter, there may be a case where a rough surface occurs in a pressed product when work is performed. On the other hand, in the case where the delivery temperature is lower than 750° C., there is an increase in load on the rolling process due to an increase in rolling load. In addition, there is an increase in rolling reduction ratio under a condition in which austenite is not recrystallized. As a result, since it is not possible to achieve the desired grain diameter, there is a marked in-plane anisotropy in a final product due to the growth of an abnormal texture, which results in a deterioration not only in the uniformity (stability) in material quality but also in ductility. In addition, since there is an increase in the grain diameter of ferrite of a final annealed steel sheet, it is difficult to achieve the desired strength. Therefore, it is necessary that the finishing delivery temperature of hot rolling be 750° C. or higher and 1000° C. or lower. It is preferable that the finishing delivery temperature of hot rolling be 800° C. or higher. It is preferable that the finishing delivery temperature of hot rolling be 950° C. or lower.

Coiling Temperature after Hot Rolling: 300° C. or Higher and 750° C. or Lower

In the case where the coiling temperature after hot rolling has been performed is higher than 750° C., since there is an increase in the grain diameter of ferrite in the hot-rolled steel sheet microstructure, there is an increase in the grain diameter of ferrite of a final annealed steel sheet, which makes it difficult to achieve the desired strength. On the other hand, in the case where the coiling temperature after hot rolling has been performed is lower than 300° C., since there is an increase in the strength of the hot-rolled steel sheet, there is an increase in rolling load in a cold rolling process and there is a deterioration in a steel sheet shape, resulting in a deterioration in productivity. Therefore, it is necessary that the coiling temperature after hot rolling has been performed be 300° C. or higher and 750° C. or lower. It is preferable that the coiling temperature after hot rolling has been performed be 400° C. or higher. It is preferable that the coiling temperature after hot rolling has been performed be 650° C. or lower.

Incidentally, in a hot rolling process, finish rolling may be continuously performed by connecting steel sheets which have been subjected to rough rolling. In addition, the steel sheet which has been subjected to rough rolling may be coiled. In addition, to decrease a rolling load when hot rolling is performed, lubrication rolling may be performed in part or all of the finish rolling. It is also preferable that lubrication rolling be performed from the viewpoint of uniformizing the shape and material quality of a steel sheet. Here, in the case where lubrication rolling is performed, it is preferable that the friction coefficient be 0.10 or more and 0.25 or less.

The hot-rolled steel sheet obtained as described above is optionally subjected to pickling. It is preferable that pickling be performed, because this makes it possible to remove oxides from the steel sheet surface, which results in an improvement in phosphatability and quality of coating. In the case where a hot-rolled steel sheet is heated and held, to remove oxides on the steel sheet surface, pickling may be performed once after heating and holding followed by cooling have been performed, or the pickling process may be divided into multiple times. In the case where the pickling process is divided into multiple times, it is preferable that pickling be performed after heating and holding followed by cooling have been performed, because this makes it possible to more effectively remove oxides on the steel sheet surface. In the case where heating and holding is performed plural times, pickling may be performed each time after heating and holding followed by cooling have been performed.

Holding in a Temperature Range Equal to or Lower than the $Ac_1$ Transformation Temperature for More than 1800 s It is preferable that a hot-rolled steel sheet be held in a temperature range equal to or lower than the $Ac_1$ transformation temperature for more than 1800 s, because this softens the steel sheet which is to be subjected to a subsequent cold rolling process. In the case where the steel sheet is held in a temperature range equal to or lower than the $Ac_1$ transformation temperature, since Mn is concentrated in austenite, hard martensite and retained austenite are formed after cooling has been performed. As a result, it is possible to realize a preferable condition in which a value calculated by dividing the sum of the area fraction of tempered martensite having a circle-equivalent grain diameter of 3 μm or less and the area fraction of retained austenite having a circle-equivalent grain diameter of 3 μm or less by the sum of the area fraction of all the tempered martensite and the area fraction of all the retained austenite is 0.6 or more.

Incidentally, as a heating treatment method, any one of annealing methods such as a continuous annealing method and a batch annealing method may be used. In addition, when cooling is performed to room temperature after the heat treatment has been performed, there is no particular limitation on the method or cooling rate used for cooling, and any one of furnace cooling and natural cooling in batch annealing, gas jet cooling, mist cooling, and water cooling in continuous annealing, and so forth may be performed. In addition, when a pickling treatment is performed, a common method may be used.

Cold Rolling

The obtained steel sheet is subjected to cold rolling. Although there is no particular limitation on the cold rolling reduction ratio, it is preferable that the cold rolling reduction ratio be 15% to 80%. By performing cold rolling with a cold rolling reduction ratio in such a range, since it is possible to achieve a desired sufficiently recrystallized microstructure, there is an improvement in ductility.

Holding in temperature range equal to or higher than $Ac_3$ transformation temperature for 20 s to 1800 s In the case where the steel sheet is held in a temperature range lower than the $Ac_3$ transformation temperature or for less than 20 s, since recrystallization does not sufficiently progress, it is not possible to form the desired microstructure, which results in a deterioration in ductility, stretch flangeability, and bendability. In addition, the surface concentration of Mn does not sufficiently progress for achieving quality of coating in subsequent processes. On the other hand, in the case where holding is performed for more than 1800 s, the effect due to surface concentration of Mn becomes saturated.

Cooling to a Cooling Stop Temperature of 50° C. or Higher and 350° C. or Lower and Holding at Cooling Stop Temperature for 2 s to 600 s The technological thought of aspects of the present invention is characterized in that, by forming thin film-like austenite (nucleation site of austenite which is less likely to come into contact with ferrite) in a microstructure before annealing is performed, such film-like austenite is made into lath-shaped austenite (austenite which is less likely to come into contact with ferrite) in the subsequent annealing process, and Mn is concentrated in such lath-shaped austenite. By cooling the steel sheet to a cooling stop temperature of 50° C. or higher and 350° C. or lower and by holding the steel sheet at the cooling stop temperature, film-like austenite, which is made into lath-shaped austenite in the subsequent annealing process, is formed. In the case where holding is performed at a temperature of lower than 50° C., since martensitic transformation is completed, there is no film-like austenite left, which results in lath-shaped austenite not being formed. In addition, in the case where holding is performed at a temperature of higher than 350° C., film-like austenite is decomposed, which results in lath-shaped austenite not being formed. Therefore, in the case where holding is performed at a temperature of lower than 50° C. or higher than 350° C., since it is not possible to form the nucleation site of retained austenite, which is less likely to come into contact with ferrite, a large number of retained austenite grains having three or more different crystal orientations are formed at grain boundaries and the triple junctions of grain boundaries in the subsequent annealing process. As a result, since there is an increase in the number of retained austenite grains adjacent to three or more ferrite grains having different crystal orientations in relation to the number of retained austenite grains which are less likely to come into contact with the above-described three or more ferrite grains having different crystal orientations, it is not possible to form the desired microstructure. In addition, also in the case where holding is performed for less than 2 s, since it is not possible to form retained austenite which is less likely to come into contact with ferrite, it is not possible to form the desired microstructure. Moreover, also in the case where holding is performed for more than 600 s, since retained austenite which is less likely to come into contact with ferrite is decomposed, there is an increase in the number of retained austenite grains adjacent to three or more ferrite grains having different crystal orientations, which results in the desired microstructure not being formed.

Holding in temperature range equal to or higher than $Ac_1$ transformation temperature and equal to or lower than ($Ac_1$ transformation temperature+150° C.) for 20 s to 1800 s The requirement that holding be performed in a temperature range equal to or higher than the $Ac_1$ transformation temperature and equal to or lower than ($Ac_1$ transformation temperature+150° C.) for 20 s to 1800 s is a significantly important constituent feature in accordance with aspects of the present invention. In the case where holding is performed in a temperature range lower than the $Ac_1$ transformation temperature and for less than 20 s, since carbides which are formed when heating is performed are left undissolved, it is difficult to achieve sufficient area fractions of retained austenite, which results in a deterioration in strength due to a deterioration in ductility or due to an excessive amount of ferrite being formed. In the case where holding is performed in a temperature range higher than ($Ac_1$ transformation temperature+150° C.), since it is not possible to achieve a desired value calculated by dividing the average Mn content (mass %) in retained austenite by the average Mn content (mass %) in ferrite, and since it is not possible to achieve a sufficient area fraction of retained austenite, there is a deterioration in ductility. It is preferable that holding be performed in a temperature range equal to or lower than ($Ac_1$ transformation temperature+100° C.). In the case where holding is performed for more than 1800 s, it is not possible to achieve a desired value calculated by dividing the average Mn content (mass %) in retained austenite by the average Mn content (mass %) in ferrite, there is an increase in strength due to an increase in the amount of martensite, and it is not possible to achieve the area fraction of retained austenite sufficient for achieving satisfactory ductility.

In addition, following cooling to a cooling stop temperature after having performed holding in a temperature range equal to or higher than the $Ac_1$ transformation temperature and equal to or lower than ($Ac_1$ transformation temperature+150° C.) for 20 s to 1800 s, by again performing holding in a temperature range equal to or higher than the $Ac_1$ transformation temperature and equal to or lower than ($Ac_1$ transformation temperature+150° C.) for 20 s to 1800 s, it is possible to achieve good material quality. In the case where holding is performed in a temperature range lower than the $Ac_1$ transformation temperature or for less than 20 s, since it is not possible to achieve sufficient area fractions of retained austenite, there is a deterioration in ductility. On the other hand, in the case where holding is performed in a temperature range higher than the $Ac_1$ transformation temperature+150° C. or for more than 1800 s, since there is an excessive increase in the area fraction of martensite, there is a deterioration in ductility.

It is preferable that the above-described cooling stop temperature be 200° C. or lower in the case where pickling is performed or 200° C. to 500° C. in the case where pickling is not performed. Here, although there is no particular limitation on the method used for cooling to the above-described cooling stop temperature, for example, natural cooling may be performed.

Galvanizing Treatment

In the case where a galvanizing treatment is performed, the steel sheet which has been subjected to an annealing treatment as described above is dipped in a galvanizing bath having a temperature of 440° C. or higher and 500° C. or lower to perform a galvanizing treatment, and a coating weight is then adjusted by using, for example, a gas wiping method. Here, it is preferable that a galvanizing bath containing 0.08% or more and 0.30% or less of Al be used for a galvanizing treatment.

In the case where an alloying treatment is performed on a galvanizing layer, an alloying treatment is performed in a temperature range of 450° C. or higher and 600° C. or lower on the galvanizing layer which has been subjected to the galvanizing treatment. In the case where an alloying treatment is performed at a temperature of higher than 600° C., since untransformed austenite transforms into pearlite, it is not possible to achieve the desired area fraction of retained austenite, which may result in a deterioration in ductility. Therefore, in the case where an alloying treatment is performed on a galvanizing layer, it is preferable that an alloying treatment on a galvanizing layer be performed in a temperature range of 450° C. or higher and 600° C. or lower.

Although there is no particular limitation on the other conditions applied for the manufacturing method, from the viewpoint of productivity, it is preferable that the above-described annealing treatment (heating and holding) be performed by using continuous annealing equipment. In addition, it is preferable that a series of treatments including an annealing treatment, a galvanizing treatment, an alloying treatment on a galvanizing layer, and the like be performed by using a CGL (continuous galvanizing line), which is a galvanizing treatment line.

Holding in a Temperature Range of 50° C. or Higher and 400° C. or Lower for 1800 s or More In accordance with aspects of the present invention, it is important to hold in a temperature range of 50° C. or higher and 400° C. or lower for 1800 s or more as a final heat treatment. In the case where holding is performed in a temperature range of lower than 50° C. or for less than 1800 s, it is not possible to achieve the sufficient area fraction of tempered martensite, and diffusible hydrogen in steel is not emitted from a steel sheet. Therefore, there is a deterioration in local elongation, stretch flangeability, and bendability, and it is not possible to achieve a high yield ratio due to a decrease in yield stress. On the other hand, in the case where holding is performed in a temperature range of higher than 400° C., since retained austenite is decomposed, it is not possible to achieve the sufficient area fraction of retained austenite, which results in a deterioration in the ductility of steel.

Incidentally, skin pass rolling may be performed on the high-strength galvanized steel sheet described above for the purpose of correcting a shape, adjusting surface roughness, and so forth. It is preferable that the rolling reduction ratio of skin pass rolling be 0.1% or more and 2.0% or less. In the case where the rolling reduction ratio of skin pass rolling is lower than 0.1%, there is an insufficient effect, and there is a difficulty in control. Therefore, the preferable lower limit is set to be 0.1%. In addition, in the case where the rolling reduction ratio of skin pass rolling is higher than 2.0%, there is a marked deterioration in productivity. Therefore, the preferable upper limit is set to be 2.0%. Here, skin pass rolling may be performed online or offline. In addition, skin pass rolling may be performed once to obtain the target rolling reduction ratio, or a skin pass rolling may be divided into several times. In addition, various kinds of coating treatments such as oil coating and resin coating may be performed.

EXAMPLES

Steels having chemical compositions given in Table 1 with a balance of Fe and incidental impurities were obtained by steelmaking by using a converter and made into steel slabs by using a continuous casting method. The obtained steel slabs were reheated to a temperature of 1250° C., subjected to hot rolling, optionally subjected to a heat treatment in a temperature range equal to or lower than the $Ac_1$ transformation temperature, subjected to cold rolling, subjected to heating and holding in a temperature range equal to or higher than the $Ac_3$ transformation temperature, cooled, and subjected to annealing in a temperature range equal to or higher than the $Ac_1$ transformation temperature and equal to or lower than ($Ac_1$ transformation temperature+150° C.) to obtain high strength cold-rolled steel sheets under the conditions given in Tables 2 and 3. Moreover, the obtained cold-rolled steel sheets were subjected to a galvanizing treatment to obtain galvanized steel sheets (GI) and galvannealed steel sheets (GA). Here, in the case where an annealing treatment in a temperature range equal to or higher than the $Ac_1$ transformation temperature and equal to or lower than ($Ac_1$ transformation temperature+150° C.) was performed twice, cooling to room temperature was performed after the first annealing treatment had been performed, and the second annealing treatment was performed thereafter. The galvanizing bath for galvanized steel sheets (GI) contained Al: 0.19 mass %, and the galvanizing bath for galvannealed steel sheets (GA) contained Al: 0.14 mass %. The galvanizing baths had a temperature of 465° C. The coating weight was 45 g/m$^2$ per side (double-sided coating), and, in the case of GA, the Fe concentration in the coating layer was adjusted to be 9 mass % or more and 12 mass % or less.

The cross-sectional microstructure, tensile properties, stretch flangeability, bendability, and coatability of obtained steel sheets were investigated, and the results are given in Tables 4, 5, and 6.

Incidentally, the $Ac_1$ transformation temperature and the $Ac_3$ transformation temperature were calculated by using the following formulas.

$$Ac_1 \text{ transformation temperature (° C.)} = 751 - 16\times(\%\,C) + 11\times(\%\,Si) - 28\times(\%\,Mn) - 5.5\times(\%\,Cu) - 16\times(\%\,Ni) + 13\times(\%\,Cr) + 3.4\times(\%\,Mo)$$

$$Ac_3 \text{ transformation temperature (° C.)} = 910 - 203\times\sqrt{(\%\,C)} + 45\times(\%\,Si) - 30\times(\%\,Mn) - 20\times(\%\,Cu) - 15\times(\%\,Ni) + 11\times(\%\,Cr) + 32\times(\%\,Mo) + 104\times(\%\,V) + 400\times(\%\,Ti) + 200\times(\%\,Al)$$

Here, each of (% C), (% Si), (% Mn), (% Ni), (% Cu), (% Cr), (% Mo), (% V), (% Ti), and (% Al) denotes the content (mass %) of the corresponding element.

TABLE 1

| Steel | Chemical Composition (mass %) | | | | | | | | | | | | | | | |
|---|---|---|---|---|---|---|---|---|---|---|---|---|---|---|---|---|
| Grade | C | Si | Mn | P | S | N | Al | Ti | Nb | V | W | B | Ni | Cr | Mo | Cu |
| A | 0.162 | 0.57 | 3.50 | 0.022 | 0.0023 | 0.0035 | 0.031 | 0.049 | — | — | — | — | — | — | — | — |
| B | 0.180 | 0.80 | 3.21 | 0.024 | 0.0024 | 0.0041 | 0.048 | 0.043 | — | — | — | — | — | — | — | — |
| C | 0.174 | 1.84 | 3.62 | 0.020 | 0.0019 | 0.0027 | 0.034 | 0.034 | — | — | — | — | — | — | — | — |
| D | 0.237 | 0.98 | 3.31 | 0.020 | 0.0030 | 0.0045 | 0.041 | — | — | — | — | — | — | — | — | — |
| E | 0.035 | 0.74 | 4.12 | 0.023 | 0.0023 | 0.0042 | 0.032 | — | — | — | — | — | — | — | — | — |
| F | 0.183 | 2.86 | 3.99 | 0.026 | 0.0018 | 0.0022 | 0.040 | 0.044 | — | — | — | — | — | — | — | — |
| G | 0.200 | 0.57 | 3.57 | 0.025 | 0.0020 | 0.0026 | 0.040 | 0.050 | — | — | — | — | — | — | — | — |
| H | 0.081 | 1.04 | 5.12 | 0.027 | 0.0026 | 0.0027 | 0.035 | — | — | — | — | — | — | — | — | — |
| I | 0.185 | 1.48 | 3.75 | 0.023 | 0.0021 | 0.0026 | 0.033 | — | — | — | — | — | — | — | — | — |
| J | 0.161 | 0.20 | 3.50 | 0.031 | 0.0023 | 0.0036 | 0.032 | 0.045 | — | — | — | — | — | — | — | — |
| K | 0.127 | 0.37 | 5.84 | 0.027 | 0.0027 | 0.0031 | 0.031 | 0.051 | — | — | — | — | — | — | — | — |
| L | 0.193 | 0.42 | 3.18 | 0.021 | 0.0027 | 0.0025 | 0.033 | — | — | — | — | — | — | — | — | — |
| M | 0.154 | 0.60 | 4.14 | 0.021 | 0.0026 | 0.0036 | 0.037 | — | — | — | — | — | — | — | — | — |
| N | 0.168 | 0.54 | 3.17 | 0.031 | 0.0019 | 0.0031 | 0.038 | 0.050 | — | — | — | — | — | — | — | — |
| O | 0.203 | 0.36 | 3.63 | 0.027 | 0.0028 | 0.0042 | 0.224 | 0.031 | — | — | — | — | — | — | — | — |
| P | 0.201 | 4.08 | 3.49 | 0.028 | 0.0027 | 0.0036 | 0.032 | — | — | — | — | — | — | — | — | — |
| Q | 0.183 | 0.63 | 8.16 | 0.026 | 0.0022 | 0.0027 | 0.034 | — | — | — | — | — | — | — | — | — |
| R | 0.171 | 0.63 | 3.86 | 0.019 | 0.0020 | 0.0040 | 0.042 | 0.391 | — | — | — | — | — | — | — | — |
| S | 0.182 | 0.78 | 3.50 | 0.030 | 0.0025 | 0.0040 | 0.045 | 0.013 | 0.043 | — | — | — | — | — | — | — |
| T | 0.200 | 1.16 | 3.60 | 0.032 | 0.0024 | 0.0027 | 0.044 | — | — | 0.056 | — | — | — | — | — | — |
| U | 0.113 | 1.18 | 4.08 | 0.027 | 0.0025 | 0.0045 | 0.045 | — | — | — | 0.018 | — | — | — | — | — |
| V | 0.136 | 0.32 | 4.07 | 0.031 | 0.0022 | 0.0045 | 0.040 | 0.019 | — | — | — | 0.0025 | — | — | — | — |
| W | 0.200 | 0.67 | 3.92 | 0.025 | 0.0022 | 0.0040 | 0.033 | 0.067 | — | — | — | — | 0.299 | — | — | — |
| X | 0.095 | 0.47 | 3.39 | 0.019 | 0.0020 | 0.0037 | 0.042 | 0.061 | — | — | — | — | — | 0.031 | — | — |
| Y | 0.099 | 1.37 | 3.09 | 0.029 | 0.0023 | 0.0031 | 0.032 | 0.021 | — | — | — | — | — | — | 0.061 | — |
| Z | 0.108 | 0.55 | 3.58 | 0.024 | 0.0024 | 0.0026 | 0.041 | | — | — | — | — | — | — | — | 0.243 |
| AA | 0.118 | 0.51 | 3.14 | 0.025 | 0.0021 | 0.0033 | 0.036 | 0.034 | — | — | — | — | — | — | — | — |
| AB | 0.161 | 0.45 | 3.17 | 0.021 | 0.0025 | 0.0027 | 0.033 | 0.080 | — | — | — | — | — | — | — | — |
| AC | 0.196 | 0.70 | 3.58 | 0.019 | 0.0026 | 0.0030 | 0.033 | — | — | — | — | — | — | — | — | — |
| AD | 0.199 | 0.37 | 3.23 | 0.032 | 0.0024 | 0.0025 | 0.041 | — | 0.004 | — | — | — | — | — | — | — |
| AE | 0.212 | 0.27 | 3.71 | 0.023 | 0.0027 | 0.0039 | 0.032 | — | 0.031 | — | — | — | — | — | — | — |
| AF | 0.212 | 0.93 | 3.97 | 0.023 | 0.0024 | 0.0039 | 0.040 | — | — | — | — | — | — | — | — | — |
| AG | 0.194 | 1.26 | 3.83 | 0.022 | 0.0025 | 0.0037 | 0.034 | — | — | — | — | — | — | — | — | — |
| AH | 0.237 | 0.03 | 3.13 | 0.027 | 0.0024 | 0.0027 | 0.041 | 0.012 | — | — | — | — | — | — | — | — |
| AI | 0.080 | 0.06 | 4.12 | 0.022 | 0.0027 | 0.0035 | 0.049 | — | — | — | — | — | — | — | — | — |

TABLE 1-continued

| Steel Grade | Chemical Compositon (mass %) Sn | Sb | Ta | Ca | Mg | Zr | REM | $Ac_1$ Transformation Temperature (° C.) | $Ac_3$ Transformation Temperature (° C.) | Note |
|---|---|---|---|---|---|---|---|---|---|---|
| A | — | — | — | — | — | — | — | 657 | 775 | Example Steel |
| B | — | — | — | — | — | — | — | 667 | 790 | Example Steel |
| C | — | — | — | — | — | — | — | 667 | 820 | Example Steel |
| D | — | — | — | — | — | — | — | 665 | 764 | Example Steel |
| E | — | — | — | — | — | — | — | 643 | 788 | Example Steel |
| F | — | — | — | — | — | — | — | 668 | 840 | Example Steel |
| G | — | — | — | — | — | — | — | 654 | 746 | Example Steel |
| H | — | — | — | — | — | — | — | 618 | 752 | Example Steel |
| I | — | — | — | — | — | — | — | 659 | 783 | Example Steel |
| J | — | — | — | — | — | — | — | 653 | 739 | Example Steel |
| K | — | — | — | — | — | — | — | 590 | 685 | Example Steel |
| L | — | — | — | — | — | — | — | 663 | 751 | Example Steel |
| M | — | — | — | — | — | — | — | 639 | 741 | Example Steel |
| N | — | — | — | — | — | — | — | 665 | 764 | Example Steel |
| O | — | — | — | — | — | — | — | 650 | 771 | Example Steel |
| P | — | — | — | — | — | — | — | 695 | 904 | Comparative |
| Q | — | — | — | — | — | — | — | 527 | 613 | Comparative Steel |
| R | — | — | — | — | — | — | — | 647 | 903 | Comparative Steel |
| S | — | — | — | — | — | — | — | 659 | 768 | Example Steel |
| T | — | — | — | — | — | — | — | 660 | 778 | Example Steel |
| U | — | — | — | — | — | — | — | 648 | 781 | Example Steel |
| V | — | — | — | — | — | — | — | 638 | 743 | Example Steel |
| W | — | — | — | — | — | — | — | 641 | 761 | Example Steel |
| X | — | — | — | — | — | — | — | 660 | 776 | Example Steel |
| Y | — | — | — | — | — | — | — | 678 | 832 | Example Steel |
| Z | — | — | — | — | — | — | — | 655 | 764 | Example Steel |
| AA | 0.005 | — | — | — | — | — | — | 667 | 790 | Example Steel |
| AB | — | 0.009 | — | — | — | — | — | 665 | 792 | Example Steel |
| AC | — | — | 0.008 | — | — | — | — | 655 | 751 | Example Steel |
| AD | 0.006 | — | — | — | — | — | — | 661 | 747 | Example Steel |
| AE | — | — | 0.007 | — | — | — | — | 647 | 724 | Example Steel |
| AF | — | — | — | 0.0035 | — | — | — | 647 | 747 | Example Steel |
| AG | — | — | — | — | 0.0022 | — | — | 654 | 769 | Example Steel |
| AH | — | — | — | — | — | 0.0030 | — | 660 | 727 | Example Steel |
| AI | — | — | — | — | — | — | 0.0028 | 635 | 741 | Example Steel |

Underlined portion: out of the range of the present invention.
"—" denotes a content of a level of an incidental impurity.

TABLE 2

| No. | Steel Grade | Finishing Delivery Temperature (° C.) | Coiling Temperature (° C.) | Heat Treatment on Hot-rolled steel sheet: Heat Treatment Temperature (° C.) | Heat Treatment on Hot-rolled steel sheet: Heat Treatment Time (s) | Cold Rolling Reduction Ratio (%) | First Annealing Treatment on Cold-rolled Steel Sheet: Heat Treatment Temperature (° C.) | First Annealing Treatment on Cold-rolled Steel Sheet: Heat Treatment Time (s) | First Annealing Treatment on Cold-rolled Steel Sheet: Cooling Stop Temperature (° C.) | First Annealing Treatment on Cold-rolled Steel Sheet: Holding Time at Cooling Stop Temperature (s) |
|---|---|---|---|---|---|---|---|---|---|---|
| 1 | A | 870 | 470 | 500 | 18000 | 58.8 | 830 | 170 | 180 | 240 |
| 2 | A | 840 | 480 | 580 | 7200 | 56.3 | 810 | 110 | 150 | 140 |
| 3 | A | 890 | 480 | 530 | 23400 | 64.7 | 835 | 140 | 120 | 180 |
| 4 | A | 870 | 480 | 510 | 14400 | 57.1 | 850 | 120 | 160 | 130 |
| 5 | A | 900 | 510 | 560 | 9000 | 66.7 | 830 | 130 | 280 | 500 |
| 6 | A | 860 | 500 | 540 | 10800 | 46.7 | 830 | 140 | 140 | 520 |
| 7 | A | 900 | 560 | 590 | 18000 | 53.3 | 840 | 140 | 140 | 300 |
| 8 | A | 900 | 510 | 540 | 7200 | 58.8 | 870 | 180 | 300 | 240 |
| 9 | A | 920 | 510 | 600 | 23400 | 62.5 | 600 | 160 | 200 | 180 |
| 10 | A | 920 | 500 | 550 | 14400 | 58.8 | 870 | 120 | 450 | 140 |
| 11 | A | 880 | 560 | 550 | 18000 | 57.1 | 850 | 190 | 20 | 260 |
| 12 | A | 885 | 480 | 510 | 9000 | 61.1 | 800 | 350 | 220 | 1000 |
| 13 | A | 890 | 520 | | | 46.2 | 830 | 260 | 170 | 500 |
| 14 | B | 880 | 490 | 540 | 21600 | 54.8 | 850 | 350 | 180 | 540 |
| 15 | C | 920 | 520 | 550 | 21600 | 52.9 | 860 | 150 | 250 | 180 |
| 16 | A | 720 | 520 | 550 | 18000 | 47.1 | 850 | 180 | 140 | 170 |
| 17 | A | 900 | 840 | 590 | 36000 | 56.5 | 880 | 200 | 180 | 280 |
| 18 | A | 860 | 580 | 700 | 21600 | 58.8 | 890 | 190 | 110 | 250 |

TABLE 2-continued

| | | | | | | | | | | |
|---|---|---|---|---|---|---|---|---|---|---|
| 19 | A | 880 | 580 | 510 | 14400 | 52.9 | 830 | 150 | 100 | 300 |
| 20 | A | 860 | 570 | | | 52.9 | 870 | 140 | 170 | 240 |
| 21 | A | 890 | 540 | 520 | 18000 | 57.1 | 820 | 120 | 170 | 180 |
| 22 | A | 860 | 580 | 590 | 9000 | 51.7 | 810 | 350 | 100 | 530 |
| 23 | A | 850 | 560 | 590 | 10800 | 58.8 | 805 | 310 | 120 | 370 |
| 24 | A | 850 | 550 | 520 | 18000 | 63.2 | 800 | 350 | 180 | 525 |
| 25 | A | 860 | 460 | 510 | 7200 | 66.7 | 810 | 150 | 150 | 170 |
| 26 | A | 860 | 570 | 550 | 23400 | 64.7 | 820 | 180 | 110 | 260 |
| 27 | A | 925 | 580 | 600 | 32400 | 57.1 | 800 | 160 | 180 | 120 |
| 28 | A | 870 | 620 | 520 | 23400 | 56.3 | 840 | 160 | 150 | 180 |
| 29 | A | 870 | 620 | 520 | 23400 | 56.3 | 840 | 160 | 150 | 180 |
| 30 | D | 900 | 570 | 560 | 14400 | 58.8 | 890 | 200 | 170 | 190 |
| 31 | E | 860 | 560 | 560 | 18000 | 58.8 | 890 | 350 | 160 | 180 |
| 32 | F | 880 | 610 | 550 | 32400 | 57.1 | 890 | 130 | 100 | 140 |
| 33 | G | 840 | 450 | 545 | 18000 | 53.3 | 780 | 90 | 150 | 400 |

| Second Annealing Treatment on Cold-rolled Steel Sheet | | Third Annealing Treatment on Cold-rolled Steel Sheet | | | Annealing Treatment on Galvanized Steel Sheet | | | |
|---|---|---|---|---|---|---|---|---|
| Heat Treatment Temperature (° C.) | Heat Treatment Time (s) | Heat Treatment Temperature (° C.) | Heat Treatment Time (s) | Alloying Temperature (° C.) | Heat Treatment Temperature (° C.) | Heat Treatment Time (s) | Kind* | Note |
| 680 | 150 | 690 | 180 | | 50 | 43200 | GI | Example |
| 690 | 180 | 680 | 150 | | 150 | 18000 | GI | Example |
| 700 | 120 | 695 | 300 | 550 | 90 | 36000 | GA | Example |
| 690 | 180 | 690 | 150 | 530 | 160 | 23400 | GA | Example |
| 720 | 300 | 700 | 210 | | 200 | 21600 | GI | Example |
| 685 | 200 | 720 | 240 | | 210 | 7200 | GI | Example |
| 700 | 210 | 740 | 160 | 500 | 175 | 10800 | GA | Example |
| 710 | 180 | 710 | 140 | 560 | 210 | 9000 | GA | Example |
| 685 | 240 | 680 | 120 | | 200 | 10800 | GI | Comparative Example |
| 680 | 330 | 690 | 130 | 520 | 80 | 36000 | GA | Comparative Example |
| 730 | 190 | 720 | 120 | 500 | 90 | 32400 | GA | Comparative Example |
| 705 | 210 | | | | 120 | 28800 | GI | Comparative Example |
| 685 | 180 | 695 | 140 | 540 | 130 | 28800 | GA | Example |
| 690 | 120 | 680 | 150 | | 140 | 28800 | GI | Example |
| 690 | 210 | 705 | 175 | 550 | 250 | 10800 | GA | Example |
| 730 | 250 | 740 | 250 | 530 | 300 | 9000 | GA | Comparative Example |
| 660 | 150 | 670 | 180 | 510 | 150 | 14400 | GA | Comparative Example |
| 700 | 140 | 700 | 150 | 490 | 170 | 14400 | GA | Example |
| 580 | 190 | 680 | 230 | | 180 | 14400 | GI | Comparative Example |
| 810 | 240 | 680 | 150 | | 240 | 10800 | GI | Comparative Example |
| 740 | 15 | | | | 250 | 14400 | GI | Comparative Example |
| 700 | 2700 | 710 | 350 | | 290 | 14400 | GI | Comparative Example |
| 705 | 120 | 550 | 300 | 500 | 170 | 14400 | GA | Comparative Example |
| 710 | 180 | 860 | 450 | 490 | 200 | 10800 | GA | Comparative Example |
| 680 | 60 | 680 | 10 | 520 | 200 | 10800 | GA | Comparative Example |
| 710 | 150 | 710 | 3600 | 540 | 190 | 7200 | GA | Comparative Example |
| 690 | 120 | | | 530 | 30 | 14400 | GA | Comparative Example |
| 690 | 180 | | | 560 | 480 | 36000 | GA | Comparative Example |
| 690 | 180 | | | 560 | 250 | 300 | GA | Comparative Example |
| 680 | 170 | | | 530 | 200 | 14400 | GA | Example |
| 690 | 180 | 680 | 150 | | 150 | 14400 | GI | Example |
| 680 | 70 | 700 | 240 | 560 | 160 | 10800 | GA | Example |
| 690 | 50 | 680 | 90 | 510 | 150 | 10800 | GA | Example |

Underlined portion: out of the range of the present invention.

*GI: galvanized steel sheet (without an alloying treatment on a galvanizing layer), GA: galvannealed steel sheet

TABLE 3

| No. | Steel Grade | Finishing Delivery Temperature (° C.) | Coiling Temperature (° C.) | Heat Treatment on Hot-rolled steel sheet: Heat Treatment Temperature (° C.) | Heat Treatment on Hot-rolled steel sheet: Heat Treatment Time (s) | Cold Rolling Reduction Ratio (%) | First Annealing Treatment on Cold-rolled Steel Sheet: Heat Treatment Temperature (° C.) | First Annealing Treatment on Cold-rolled Steel Sheet: Heat Treatment Time (s) | First Annealing Treatment on Cold-rolled Steel Sheet: Cooling Stop Temperature (° C.) | First Annealing Treatment on Cold-rolled Steel Sheet: Holding Time at Cooling Stop Temperature (s) |
|---|---|---|---|---|---|---|---|---|---|---|
| 34 | H | 930 | 540 | 520 | 23400 | 50.0 | 780 | 160 | 150 | 150 |
| 35 | I | 890 | 500 | 530 | 28800 | 52.9 | 790 | 190 | 130 | 190 |
| 36 | J | 870 | 560 | 520 | 32400 | 48.6 | 780 | 90 | 140 | 120 |
| 37 | K | 900 | 570 | 550 | 23400 | 46.2 | 770 | 180 | 170 | 290 |
| 38 | L | 860 | 620 | 600 | 36000 | 62.5 | 800 | 150 | 130 | 190 |
| 39 | L | 890 | 620 | 550 | 28800 | 62.5 | 810 | 140 | 130 | 180 |
| 40 | M | 880 | 540 | 520 | 10800 | 58.8 | 820 | 75 | 200 | 120 |
| 41 | N | 880 | 490 | | | 52.0 | 825 | 130 | 150 | 140 |
| 42 | O | 890 | 550 | 610 | 32400 | 50.0 | 840 | 290 | 190 | 400 |
| 43 | P | 870 | 590 | 530 | 18000 | 62.5 | 910 | 160 | 130 | 190 |
| 44 | Q | 860 | 470 | 510 | 28800 | 58.8 | 810 | 50 | 130 | 190 |
| 45 | R | 870 | 620 | 550 | 32400 | 50.0 | 910 | 340 | 250 | 500 |
| 46 | S | 880 | 550 | 510 | 23400 | 46.2 | 840 | 150 | 190 | 190 |
| 47 | T | 880 | 550 | 560 | 36000 | 52.9 | 850 | 140 | 150 | 170 |
| 48 | U | 915 | 570 | | | 47.1 | 840 | 310 | 170 | 420 |
| 49 | V | 900 | 590 | 520 | 10800 | 55.6 | 820 | 170 | 140 | 260 |
| 50 | W | 930 | 520 | 520 | 18000 | 56.3 | 830 | 180 | 300 | 270 |
| 51 | X | 890 | 520 | 500 | 23400 | 58.8 | 790 | 120 | 160 | 180 |
| 52 | Y | 900 | 480 | 530 | 23400 | 64.7 | 840 | 130 | 140 | 170 |
| 53 | Z | 920 | 490 | 550 | 9000 | 62.5 | 850 | 160 | 320 | 280 |
| 54 | AA | 910 | 570 | 490 | 28800 | 56.3 | 850 | 160 | 200 | 250 |
| 55 | AB | 835 | 580 | | | 53.8 | 880 | 130 | 150 | 240 |
| 56 | AC | 880 | 580 | 520 | 32400 | 56.3 | 910 | 100 | 100 | 130 |
| 57 | AD | 910 | 530 | 530 | 10800 | 56.3 | 840 | 70 | 100 | 125 |
| 58 | AB | 840 | 560 | 540 | 10800 | 56.3 | 790 | 130 | 100 | 150 |
| 59 | AF | 880 | 510 | 520 | 14400 | 64.7 | 840 | 140 | 170 | 195 |
| 60 | AG | 830 | 510 | | | 46.7 | 850 | 170 | 100 | 200 |
| 61 | AH | 860 | 490 | 570 | 23400 | 50.0 | 840 | 240 | 170 | 300 |
| 62 | AI | 870 | 500 | 580 | 10800 | 50.0 | 820 | 310 | 120 | 180 |

| No. | Second Annealing Treatment on Cold-rolled Steel Sheet: Heat Treatment Temperature (° C.) | Second Annealing Treatment on Cold-rolled Steel Sheet: Heat Treatment Time (s) | Third Annealing Treatment on Cold-rolled Steel Sheet: Heat Treatment Temperature (° C.) | Third Annealing Treatment on Cold-rolled Steel Sheet: Heat Treatment Time (s) | Alloying Temperature (° C.) | Annealing Treatment on Galvanized Steel Sheet: Heat Treatment Temperature (° C.) | Annealing Treatment on Galvanized Steel Sheet: Heat Treatment Time (s) | Kind* | Note |
|---|---|---|---|---|---|---|---|---|---|
| 34 | 680 | 210 | 700 | 360 | 530 | 140 | 7200 | GA | Example |
| 35 | 710 | 180 | | | 530 | 130 | 14400 | GA | Example |
| 36 | 690 | 80 | 740 | 120 | | 180 | 36000 | GI | Example |
| 37 | 630 | 130 | 640 | 200 | | 210 | 10800 | GI | Example |
| 38 | 680 | 190 | 710 | 250 | 550 | 230 | 10800 | GA | Example |
| 39 | 690 | 180 | | | | 220 | 14400 | GI | Example |
| 40 | 670 | 170 | 660 | 300 | 500 | 120 | 18000 | GA | Example |
| 41 | 690 | 140 | 690 | 360 | 520 | 130 | 23400 | GA | Example |
| 42 | 700 | 80 | | | | 80 | 18000 | GI | Example |
| 43 | 700 | 190 | 710 | 250 | 550 | 150 | 36000 | GA | Comparative Example |
| 44 | 700 | 90 | 700 | 300 | | 140 | 23400 | GI | Comparative Example |
| 45 | 680 | 110 | | | 540 | 190 | 21600 | GA | Comparative Example |
| 46 | 690 | 160 | 720 | 600 | 520 | 150 | 7200 | GA | Example |
| 47 | 700 | 90 | | | 540 | 150 | 10800 | GA | Example |
| 48 | 710 | 210 | 700 | 180 | 510 | 200 | 9000 | GA | Example |
| 49 | 690 | 90 | 680 | 300 | 520 | 220 | 10800 | GA | Example |
| 50 | 680 | 110 | 725 | 200 | | 230 | 13400 | GI | Example |
| 51 | 690 | 230 | 695 | 250 | | 180 | 18000 | GI | Example |
| 52 | 710 | 140 | 700 | 270 | | 140 | 18000 | GI | Example |
| 53 | 700 | 120 | 690 | 250 | 500 | 160 | 23400 | GA | Example |
| 54 | 710 | 200 | 740 | 300 | 510 | 130 | 9000 | GA | Example |
| 55 | 710 | 230 | 720 | 340 | 520 | 100 | 23400 | GA | Example |
| 56 | 680 | 70 | 685 | 180 | | 110 | 23400 | GI | Example |
| 57 | 690 | 90 | 680 | 170 | 530 | 100 | 43200 | GA | Example |
| 58 | 680 | 150 | 730 | 160 | | 200 | 9000 | GI | Example |
| 59 | 690 | 120 | 690 | 150 | 480 | 210 | 14400 | GA | Example |
| 60 | 680 | 160 | | | | 230 | 18000 | GI | Example |

TABLE 3-continued

| | | | | | | | | | |
|---|---|---|---|---|---|---|---|---|---|
| 61 | 710 | 200 | 680 | 140 | 540 | 180 | 23400 | GA | Example |
| 62 | 690 | 130 | 680 | 150 | 510 | 140 | 36000 | GA | Example |

Underlined portion: out of the range of the present invention.

*GI: galvanized steel sheet (without an alloying treatment on a galvanizing layer), GA: galvannealed steel sheet

TABLE 4

| No. | Steel Grade | Thickness (mm) | Sum of Area Fractions of RA and TM Having a Circle-equivalent Grain Diameter of 3 μm or Less/Sum of Area Fractions of All RA and TM | Area Fraction of RA Adjacent to Three or More F Grains/ Area Fraction of All RA | Average Mn Content in RA (mass %) | Average Mn Content in F (mass %) | Average Mn Content in RA/Average Mn Content in F | Diffusible Hydrogen Content in Steel (mass ppm) |
|---|---|---|---|---|---|---|---|---|
| 1 | A | 1.4 | 0.892 | 0.508 | 6.20 | 1.97 | 3.15 | 0.27 |
| 2 | A | 1.4 | 0.875 | 0.384 | 5.63 | 1.91 | 2.95 | 0.13 |
| 3 | A | 1.2 | 0.743 | 0.492 | 5.84 | 1.95 | 2.99 | 0.13 |
| 4 | A | 1.2 | 0.870 | 0.352 | 5.90 | 1.93 | 3.06 | 0.05 |
| 5 | A | 1.2 | 0.699 | 0.525 | 4.56 | 2.98 | 1.53 | 0.16 |
| 6 | A | 1.6 | 0.808 | 0.577 | 4.86 | 2.99 | 1.63 | 0.14 |
| 7 | A | 1.4 | 0.608 | 0.441 | 4.95 | 3.04 | 1.63 | 0.14 |
| 8 | A | 1.4 | 0.810 | 0.521 | 5.03 | 3.00 | 1.68 | 0.23 |
| 9 | A | 1.2 | 0.803 | 0.780 | 4.94 | 2.08 | 2.37 | 0.11 |
| 10 | A | 1.4 | 0.867 | 0.771 | 4.31 | 1.99 | 2.17 | 0.17 |
| 11 | A | 1.2 | 0.694 | 0.702 | 4.23 | 1.39 | 3.05 | 0.21 |
| 12 | A | 1.4 | 0.816 | 0.704 | 4.13 | 2.21 | 1.87 | 0.16 |
| 13 | A | 1.4 | 0.530 | 0.490 | 5.34 | 2.26 | 2.36 | 0.09 |
| 14 | B | 1.4 | 0.850 | 0.531 | 5.21 | 2.09 | 2.49 | 0.12 |
| 15 | C | 1.6 | 0.703 | 0.426 | 5.68 | 1.46 | 3.88 | 0.22 |
| 16 | A | 1.8 | 0.871 | 0.548 | 4.93 | 2.66 | 1.85 | 0.06 |
| 17 | A | 1.0 | 0.646 | 0.533 | 3.93 | 2.59 | 1.52 | 0.12 |
| 18 | A | 1.4 | 0.401 | 0.578 | 4.54 | 2.51 | 1.81 | 0.04 |
| 19 | A | 1.6 | 0.676 | 0.414 | 5.04 | 3.11 | 1.62 | 0.23 |
| 20 | A | 1.6 | 0.675 | 0.495 | 3.86 | 2.83 | 1.36 | 0.23 |
| 21 | A | 1.2 | 0.940 | 0.442 | 4.97 | 3.22 | 1.54 | 0.24 |
| 22 | A | 1.4 | 0.869 | 0.530 | 3.88 | 3.23 | 1.20 | 0.20 |
| 23 | A | 1.4 | 0.606 | 0.416 | 4.73 | 3.12 | 1.52 | 0.24 |
| 24 | A | 1.4 | 0.655 | 0.446 | 4.86 | 2.84 | 1.71 | 0.23 |
| 25 | A | 1.2 | 0.834 | 0.477 | 4.86 | 2.80 | 1.74 | 0.09 |
| 26 | A | 1.2 | 0.789 | 0.473 | 4.67 | 2.56 | 1.82 | 0.17 |
| 27 | A | 1.2 | 0.707 | 0.436 | 6.39 | 2.81 | 2.27 | 0.42 |
| 28 | A | 1.4 | 0.705 | 0.517 | 5.38 | 2.50 | 2.15 | 0.15 |
| 29 | A | 1.4 | 0.703 | 0.514 | 5.37 | 2.45 | 2.19 | 0.44 |
| 30 | D | 1.4 | 0.649 | 0.570 | 4.70 | 2.06 | 2.28 | 0.12 |
| 31 | E | 1.4 | 0.757 | 0.549 | 6.37 | 2.78 | 2.29 | 0.29 |
| 32 | F | 1.2 | 0.609 | 0.485 | 6.38 | 2.83 | 2.25 | 0.12 |
| 33 | G | 1.4 | 0.712 | 0.497 | 5.14 | 2.28 | 2.25 | 0.18 |
| 34 | H | 1.4 | 0.890 | 0.476 | 9.98 | 3.03 | 3.29 | 0.21 |
| 35 | I | 1.6 | 0.859 | 0.522 | 5.57 | 2.71 | 2.06 | 0.22 |
| 36 | J | 1.8 | 0.908 | 0.444 | 4.99 | 1.92 | 2.60 | 0.10 |
| 37 | K | 1.4 | 0.653 | 0.532 | 10.05 | 3.45 | 2.91 | 0.24 |
| 38 | L | 1.2 | 0.659 | 0.454 | 5.37 | 2.65 | 2.03 | 0.19 |
| 39 | L | 1.2 | 0.688 | 0.519 | 5.21 | 2.49 | 2.09 | 0.23 |
| 40 | M | 1.4 | 0.756 | 0.454 | 6.92 | 2.21 | 3.13 | 0.28 |
| 41 | N | 1.2 | 0.522 | 0.465 | 5.31 | 2.22 | 2.39 | 0.19 |
| 42 | O | 1.6 | 0.871 | 0.566 | 5.41 | 2.60 | 2.08 | 0.09 |
| 43 | P | 1.2 | 0.628 | 0.497 | 5.23 | 2.64 | 1.98 | 0.22 |
| 44 | Q | 1.4 | 0.752 | 0.433 | 14.17 | 2.99 | 4.74 | 0.15 |
| 45 | R | 1.4 | 0.902 | 0.445 | 5.12 | 2.85 | 1.80 | 0.22 |
| 46 | S | 1.4 | 0.827 | 0.512 | 5.13 | 3.04 | 1.69 | 0.16 |
| 47 | T | 1.6 | 0.736 | 0.467 | 5.52 | 2.59 | 2.13 | 0.09 |
| 48 | U | 1.8 | 0.494 | 0.575 | 5.57 | 3.05 | 1.83 | 0.28 |
| 49 | V | 1.6 | 0.746 | 0.536 | 5.63 | 2.66 | 2.12 | 0.11 |
| 50 | W | 1.4 | 0.658 | 0.442 | 4.58 | 2.81 | 1.63 | 0.09 |
| 51 | X | 1.4 | 0.870 | 0.514 | 5.40 | 2.31 | 2.34 | 0.08 |
| 52 | Y | 1.2 | 0.693 | 0.501 | 5.97 | 2.26 | 2.64 | 0.06 |
| 53 | Z | 1.2 | 0.892 | 0.566 | 5.88 | 2.75 | 2.14 | 0.07 |
| 54 | AA | 1.4 | 0.904 | 0.458 | 5.59 | 2.52 | 2.22 | 0.08 |
| 55 | AB | 1.2 | 0.586 | 0.581 | 5.88 | 2.59 | 2.27 | 0.06 |
| 56 | AC | 1.4 | 0.751 | 0.496 | 5.90 | 2.93 | 2.01 | 0.10 |
| 57 | AD | 1.4 | 0.715 | 0.471 | 5.56 | 2.61 | 2.13 | 0.11 |
| 58 | AE | 1.4 | 0.616 | 0.445 | 5.57 | 2.72 | 2.05 | 0.11 |
| 59 | AF | 1.2 | 0.931 | 0.507 | 5.29 | 2.80 | 1.89 | 0.08 |

TABLE 4-continued

| No. | Steel Grade | Thickness (mm) | Sum of Area Fractions of RA and TM Having a Circle-equivalent Grain Diameter of 3 μm or Less/Sum of Area Fractions of All RA and TM | Area Fraction of RA Adjacent to Three or More F Grains/ Area Fraction of All RA | Average Mn Content in RA (mass %) | Average Mn Content in F (mass %) | Average Mn Content in RA/Average Mn Content in F | Diffusible Hydrogen Content in Steel (mass ppm) |
|---|---|---|---|---|---|---|---|---|
| 60 | AG | 1.6 | 0.550 | 0.558 | 5.48 | 2.52 | 2.17 | 0.07 |
| 61 | AH | 1.4 | 0.903 | 0.577 | 5.75 | 2.85 | 2.02 | 0.05 |
| 62 | AI | 1.4 | 0.664 | 0.536 | 5.70 | 2.85 | 2.00 | 0.09 |

Underlined portion: out of the range of the present invention.

F: ferrite, TM: tempered martensite, RA: retained austenite

TABLE 5

| No. | Area Fraction of F (%) | Area Fraction of M (%) | Area Fraction of TM (%) | Area Fraction of RA (%) | Average Grain Diameter of F (μm) | Average Grain Diameter of RA (μm) | Area Fraction of Massive RA (%) | Area Fraction of Lath-shaped RA (%) | Area Fraction of Massive RA/ (Area Fraction of Blocky RA + Area Fraction of Lath-shaped RA) | Remainder of Micro-structure |
|---|---|---|---|---|---|---|---|---|---|---|
| 1 | 53.5 | 0.9 | 19.8 | 19.1 | 5.1 | 1.0 | 9.2 | 9.9 | 0.48 | B, P, θ |
| 2 | 54.1 | 0.2 | 21.0 | 22.2 | 5.1 | 1.5 | 8.4 | 13.8 | 0.38 | B, P, θ |
| 3 | 52.9 | 0.4 | 21.9 | 22.9 | 5.1 | 2.4 | 10.2 | 13.1 | 0.44 | B, P, θ |
| 4 | 53.5 | 3.8 | 19.1 | 23.3 | 5.8 | 1.7 | 9.3 | 14.0 | 0.40 | B, P, θ |
| 5 | 55.3 | 4.7 | 17.8 | 16.1 | 5.4 | 2.4 | 7.8 | 8.6 | 0.48 | B, P, θ |
| 6 | 43.8 | 3.3 | 34.7 | 14.9 | 4.8 | 2.7 | 7.4 | 7.8 | 0.49 | B, P, θ |
| 7 | 45.9 | 3.5 | 33.9 | 15.1 | 5.7 | 0.8 | 6.9 | 8.5 | 0.45 | B, P, θ |
| 8 | 46.3 | 2.2 | 34.6 | 15.8 | 5.1 | 2.5 | 8.8 | 7.1 | 0.55 | B, P, θ |
| 9 | 41.3 | 2.1 | 34.9 | 20.7 | 5.1 | 2.6 | 18.2 | 2.6 | 0.88 | B, P, θ |
| 10 | 40.3 | 4.9 | 34.1 | 19.5 | 5.0 | 1.4 | 15.4 | 4.4 | 0.78 | B, P, θ |
| 11 | 52.0 | 1.8 | 24.8 | 21.0 | 5.2 | 2.2 | 14.2 | 7.0 | 0.67 | B, P, θ |
| 12 | 50.5 | 1.9 | 21.4 | 21.9 | 5.0 | 2.7 | 15.1 | 7.1 | 0.68 | B, P, θ |
| 13 | 46.9 | 4.9 | 22.9 | 24.7 | 5.0 | 1.6 | 7.0 | 17.9 | 0.28 | B, P, θ |
| 14 | 56.8 | 0.1 | 20.0 | 21.0 | 5.6 | 0.6 | 6.6 | 14.3 | 0.32 | B, P, θ |
| 15 | 53.2 | 3.6 | 18.1 | 25.0 | 5.3 | 0.8 | 12.6 | 12.5 | 0.50 | B, P, θ |
| 16 | 58.1 | 2.1 | 17.6 | 14.1 | 7.5 | 0.6 | 6.4 | 8.0 | 0.44 | B, P, θ |
| 17 | 57.9 | 1.8 | 12.1 | 21.7 | 8.4 | 2.2 | 10.0 | 11.7 | 0.46 | B, P, θ |
| 18 | 43.0 | 1.2 | 33.7 | 20.5 | 5.2 | 2.2 | 17.2 | 3.2 | 0.84 | B, P, θ |
| 19 | 86.9 | 0.7 | 5.2 | 2.5 | 5.0 | 2.6 | 5.5 | 1.1 | 0.83 | B, P, θ |
| 20 | 70.2 | 2.2 | 21.0 | 5.3 | 5.4 | 0.9 | 4.4 | 1.0 | 0.81 | B, P, θ |
| 21 | 81.2 | 3.2 | 11.1 | 3.7 | 5.6 | 1.9 | 5.5 | 0.5 | 0.92 | B, P, θ |
| 22 | 65.7 | 6.2 | 10.2 | 3.1 | 5.3 | 0.9 | 5.1 | 5.9 | 0.46 | B, P, θ |
| 23 | 58.8 | 3.4 | 23.3 | 5.9 | 5.4 | 1.8 | 3.9 | 6.0 | 0.39 | B, P, θ |
| 24 | 40.7 | 5.9 | 38.8 | 13.2 | 4.9 | 1.8 | 6.9 | 6.3 | 0.52 | B, P, θ |
| 25 | 55.1 | 3.0 | 18.3 | 7.4 | 5.1 | 2.7 | 7.1 | 0.6 | 0.92 | B, P, θ |
| 26 | 45.0 | 6.2 | 36.4 | 9.2 | 5.2 | 0.7 | 8.2 | 1.2 | 0.87 | B, P, θ |
| 27 | 57.8 | 4.2 | 1.1 | 24.8 | 5.5 | 0.8 | 7.3 | 17.5 | 0.29 | B, P, θ |
| 28 | 49.8 | 2.4 | 29.5 | 6.1 | 5.8 | 2.1 | 13.2 | 10.2 | 0.56 | B, P, θ |
| 29 | 55.4 | 3.5 | 1.4 | 23.2 | 5.1 | 2.2 | 13.1 | 10.4 | 0.56 | B, P, θ |
| 30 | 50.1 | 2.2 | 21.8 | 25.7 | 4.9 | 2.3 | 4.8 | 21.1 | 0.19 | B, P, θ |
| 31 | 52.4 | 1.7 | 20.4 | 17.9 | 5.1 | 1.6 | 9.0 | 9.1 | 0.50 | B, P, θ |
| 32 | 51.0 | 4.0 | 21.1 | 19.1 | 5.3 | 2.8 | 9.4 | 9.6 | 0.49 | B, P, θ |
| 33 | 49.5 | 2.5 | 19.1 | 24.8 | 4.8 | 1.8 | 12.2 | 12.8 | 0.49 | B, P, θ |
| 34 | 55.1 | 3.2 | 20.1 | 19.5 | 5.2 | 1.7 | 9.7 | 9.9 | 0.49 | B, P, θ |
| 35 | 50.1 | 4.4 | 18.7 | 25.8 | 5.1 | 1.8 | 11.1 | 14.8 | 0.43 | B, P, θ |
| 36 | 43.0 | 3.6 | 34.3 | 14.9 | 5.5 | 1.5 | 7.4 | 7.8 | 0.49 | B, P, θ |
| 37 | 51.9 | 4.4 | 14.3 | 26.9 | 5.7 | 0.5 | 10.3 | 16.8 | 0.38 | B, P, θ |
| 38 | 53.5 | 1.0 | 14.2 | 25.8 | 5.6 | 0.9 | 12.7 | 13.2 | 0.49 | B, P, θ |
| 39 | 49.7 | 4.5 | 15.7 | 26.4 | 5.3 | 2.1 | 13.2 | 13.2 | 0.50 | B, P, θ |
| 40 | 52.1 | 4.6 | 16.8 | 25.1 | 5.4 | 0.6 | 12.1 | 14.0 | 0.46 | B, P, θ |
| 41 | 56.9 | 3.3 | 19.4 | 20.4 | 5.9 | 1.5 | 10.0 | 10.6 | 0.49 | B, P, θ |
| 42 | 52.5 | 4.4 | 20.3 | 19.7 | 5.2 | 1.8 | 8.3 | 11.7 | 0.42 | B, P, θ |
| 43 | 57.0 | 0.4 | 16.3 | 24.3 | 5.8 | 0.8 | 12.7 | 11.6 | 0.52 | B, P, θ |
| 44 | 47.8 | 3.7 | 18.3 | 29.1 | 5.2 | 1.7 | 14.5 | 14.8 | 0.49 | B, P, θ |
| 45 | 49.9 | 7.2 | 15.2 | 21.9 | 5.6 | 0.9 | 11.9 | 10.2 | 0.54 | B, P, θ |
| 46 | 54.6 | 2.5 | 20.0 | 22.8 | 5.2 | 2.2 | 9.3 | 13.6 | 0.41 | B, P, θ |
| 47 | 53.2 | 3.6 | 18.0 | 22.8 | 5.7 | 1.5 | 9.2 | 13.6 | 0.40 | B, P, θ |
| 48 | 53.1 | 1.0 | 18.1 | 20.9 | 5.6 | 1.2 | 6.4 | 14.9 | 0.30 | B, P, θ |
| 49 | 50.2 | 3.7 | 21.9 | 23.6 | 5.6 | 0.9 | 7.5 | 16.0 | 0.32 | B, P, θ |
| 50 | 50.5 | 2.3 | 22.0 | 15.5 | 4.9 | 2.6 | 8.7 | 7.0 | 0.55 | B, P, θ |
| 51 | 49.9 | 2.0 | 27.6 | 20.2 | 5.6 | 1.5 | 8.9 | 11.6 | 0.43 | B, P, θ |
| 52 | 50.7 | 3.5 | 20.3 | 19.9 | 5.4 | 1.4 | 10.0 | 10.2 | 0.50 | B, P, θ |
| 53 | 51.2 | 2.5 | 20.7 | 20.6 | 5.6 | 0.4 | 8.1 | 12.8 | 0.39 | B, P, θ |

TABLE 5-continued

| No. | Area Fraction of F (%) | Area Fraction of M (%) | Area Fraction of TM (%) | Area Fraction of RA (%) | Average Grain Diameter of F (μm) | Average Grain Diameter of RA (μm) | Area Fraction of Massive RA (%) | Area Fraction of Lath-shaped RA (%) | Area Fraction of Massive RA/ (Area Fraction of Blocky RA + Area Fraction of Lath-shaped RA) | Remainder of Micro-structure |
|---|---|---|---|---|---|---|---|---|---|---|
| 54 | 53.1 | 0.8 | 20.6 | 19.9 | 5.1 | 0.8 | 9.0 | 11.2 | 0.45 | B, P, θ |
| 55 | 52.3 | 0.5 | 20.0 | 20.9 | 5.4 | 1.2 | 9.7 | 11.4 | 0.46 | B, P, θ |
| 56 | 51.8 | 4.6 | 20.3 | 20.7 | 5.6 | 1.6 | 10.1 | 10.9 | 0.48 | B, P, θ |
| 57 | 50.9 | 0.6 | 20.6 | 22.3 | 5.3 | 1.9 | 9.5 | 13.0 | 0.42 | B, P, θ |
| 58 | 51.0 | 2.3 | 20.4 | 23.2 | 5.7 | 1.5 | 11.1 | 12.0 | 0.48 | B, P, θ |
| 59 | 53.9 | 3.9 | 20.4 | 20.1 | 6.1 | 1.1 | 9.3 | 11.2 | 0.45 | B, P, θ |
| 60 | 51.8 | 3.7 | 18.9 | 21.1 | 5.5 | 2.4 | 10.0 | 11.3 | 0.47 | B, P, θ |
| 61 | 50.4 | 1.5 | 22.6 | 20.1 | 5.2 | 1.2 | 9.8 | 10.6 | 0.48 | B, P, θ |
| 62 | 51.5 | 2.3 | 19.9 | 19.8 | 5.1 | 2.3 | 9.3 | 10.8 | 0.46 | B, P, θ |

Underlined portion: out of the range of the present invention.

F: ferrite, M: as-quenched martensite, TM: tempered martensite, RA: retained austenite, B: bainite, P: pearlite, θ: carbide (such as cementite)

TABLE 6

| No | TS (MPa) | EL (%) | U. EL (%) | L. EL (%) | TS × EL (MPa · %) | YS (MPa) | YR | λ (Punching) (%) | λ (Reaming) (%) | R (mm) | R/t | Coatability | Note |
|---|---|---|---|---|---|---|---|---|---|---|---|---|---|
| 1 | 1017 | 25.1 | 18.2 | 6.9 | 25527 | 712 | 0.700 | 24 | 45 | 2.5 | 1.8 | ○ | Example |
| 2 | 1011 | 25.9 | 18.8 | 7.1 | 26185 | 720 | 0.712 | 26 | 56 | 2.4 | 1.7 | ○ | Example |
| 3 | 1019 | 24.8 | 17.6 | 7.2 | 25271 | 715 | 0.702 | 21 | 49 | 2.0 | 1.7 | ○ | Example |
| 4 | 1025 | 27.1 | 20.3 | 6.8 | 27778 | 719 | 0.701 | 30 | 56 | 1.2 | 1.0 | ○ | Example |
| 5 | 1200 | 13.9 | 9.8 | 4.1 | 16680 | 845 | 0.704 | 20 | 33 | 1.6 | 1.3 | ○ | Example |
| 6 | 1227 | 15.1 | 11.1 | 4.0 | 18528 | 1002 | 0.817 | 21 | 41 | 2.4 | 1.5 | ○ | Example |
| 7 | 1198 | 13.8 | 9.9 | 3.9 | 16532 | 923 | 0.770 | 24 | 44 | 2.0 | 1.4 | ○ | Example |
| 8 | 1197 | 15.0 | 11.0 | 4.0 | 17955 | 925 | 0.773 | 22 | 41 | 2.8 | 2.0 | ○ | Example |
| 9 | 1053 | 22.1 | 18.9 | 3.2 | 23271 | 741 | 0.704 | 14 | 45 | 3.6 | 3.0 | ○ | Comparative Example |
| 10 | 982 | 24.2 | 20.2 | 4.0 | 23764 | 722 | 0.735 | 14 | 47 | 4.8 | 3.4 | ○ | Comparative Example |
| 11 | 1085 | 21.4 | 21.0 | 0.4 | 23219 | 780 | 0.719 | 5 | 47 | 3.8 | 3.2 | ○ | Comparative Example |
| 12 | 1050 | 22.4 | 18.8 | 3.6 | 23520 | 736 | 0.701 | 13 | 40 | 4.0 | 2.9 | ○ | Comparative Example |
| 13 | 1027 | 26.6 | 20.6 | 6.0 | 27318 | 721 | 0.702 | 31 | 52 | 1.6 | 1.1 | ○ | Example |
| 14 | 1013 | 25.7 | 18.7 | 7.0 | 26034 | 740 | 0.731 | 21 | 61 | 2.0 | 1.4 | ○ | Example |
| 15 | 1001 | 25.2 | 17.7 | 7.5 | 25225 | 703 | 0.702 | 22 | 46 | 3.2 | 2.0 | ○ | Example |
| 16 | 961 | 11.1 | 8.1 | 3.0 | 10667 | 871 | 0.906 | 17 | 42 | 2.0 | 1.1 | ○ | Comparative Example |
| 17 | 943 | 29.9 | 20.0 | 9.9 | 28196 | 684 | 0.725 | 32 | 58 | 0.8 | 0.8 | ○ | Comparative Example |
| 18 | 1000 | 23.6 | 17.8 | 5.8 | 23600 | 721 | 0.721 | 15 | 43 | 4.5 | 2.5 | ○ | Example |
| 19 | 901 | 18.7 | 11.5 | 7.2 | 16849 | 671 | 0.745 | 30 | 43 | 1.0 | 0.6 | ○ | Comparative Example |
| 20 | 985 | 19.0 | 10.5 | 8.5 | 18715 | 602 | 0.611 | 36 | 60 | 3.0 | 1.9 | ○ | Comparative Example |
| 21 | 976 | 19.7 | 11.3 | 8.4 | 19227 | 778 | 0.797 | 17 | 62 | 2.0 | 1.7 | ○ | Comparative Example |
| 22 | 1211 | 11.3 | 8.3 | 3.0 | 13684 | 902 | 0.745 | 12 | 51 | 2.4 | 1.7 | ○ | Comparative Example |
| 23 | 995 | 18.9 | 13.7 | 5.2 | 18806 | 601 | 0.604 | 35 | 48 | 2.5 | 1.8 | ○ | Comparative Example |
| 24 | 1121 | 14.1 | 10.5 | 3.6 | 15806 | 795 | 0.709 | 15 | 46 | 3.2 | 2.3 | ○ | Comparative Example |
| 25 | 1003 | 18.5 | 13.1 | 5.4 | 18556 | 582 | 0.580 | 42 | 60 | 0.5 | 0.4 | ○ | Comparative Example |
| 26 | 1080 | 15.3 | 9.5 | 5.8 | 16524 | 697 | 0.645 | 19 | 52 | 3.0 | 2.5 | ○ | Comparative Example |
| 27 | 1051 | 21.0 | 19.9 | 1.1 | 22071 | 598 | 0.569 | 13 | 43 | 4.4 | 3.7 | ○ | Comparative Example |
| 28 | 1086 | 12.5 | 9.7 | 2.8 | 13575 | 765 | 0.704 | 20 | 50 | 2.5 | 1.8 | ○ | Comparative Example |
| 29 | 1081 | 20.0 | 18.5 | 1.5 | 21620 | 545 | 0.504 | 11 | 51 | 5.4 | 3.9 | ○ | Comparative Example |
| 30 | 1072 | 26.5 | 16.2 | 10.3 | 28408 | 750 | 0.700 | 27 | 62 | 2.0 | 1.4 | ○ | Example |
| 31 | 982 | 21.2 | 15.0 | 6.2 | 20818 | 691 | 0.704 | 23 | 41 | 2.5 | 1.8 | ○ | Example |
| 32 | 999 | 24.3 | 17.2 | 7.1 | 24276 | 699 | 0.700 | 22 | 40 | 1.8 | 1.5 | Δ | Example |
| 33 | 1055 | 28.0 | 18.1 | 9.9 | 29540 | 743 | 0.704 | 27 | 48 | 2.0 | 1.4 | ○ | Example |
| 34 | 993 | 21.5 | 14.1 | 7.4 | 21350 | 712 | 0.717 | 22 | 55 | 2.4 | 1.7 | ○ | Example |
| 35 | 1023 | 23.3 | 16.1 | 7.2 | 23836 | 719 | 0.703 | 22 | 47 | 2.6 | 1.6 | ○ | Example |
| 36 | 1182 | 15.2 | 8.6 | 6.6 | 17966 | 899 | 0.761 | 24 | 37 | 3.0 | 1.7 | ○ | Example |
| 37 | 996 | 29.1 | 21.6 | 7.5 | 28984 | 703 | 0.706 | 29 | 53 | 2.2 | 1.6 | ○ | Example |
| 38 | 987 | 22.4 | 15.6 | 6.8 | 22109 | 705 | 0.714 | 22 | 44 | 1.6 | 1.3 | ○ | Example |
| 39 | 1004 | 22.5 | 15.6 | 6.9 | 22590 | 711 | 0.708 | 23 | 45 | 2.0 | 1.7 | ○ | Example |
| 40 | 1023 | 26.1 | 20.1 | 6.0 | 26700 | 721 | 0.705 | 20 | 46 | 2.5 | 1.8 | ○ | Example |
| 41 | 1028 | 23.2 | 16.0 | 7.2 | 23850 | 748 | 0.728 | 24 | 46 | 2.0 | 1.7 | ○ | Example |
| 42 | 998 | 23.1 | 17.3 | 5.8 | 23054 | 733 | 0.734 | 23 | 46 | 1.6 | 1.0 | ○ | Example |
| 43 | 986 | 21.6 | 15.7 | 5.9 | 21298 | 742 | 0.753 | 23 | 52 | 2.5 | 2.1 | x | Comparative Example |
| 44 | 982 | 31.1 | 24.1 | 7.0 | 30540 | 749 | 0.763 | 22 | 44 | 2.0 | 1.4 | x | Comparative Example |
| 45 | 1093 | 21.1 | 16.0 | 5.1 | 23062 | 796 | 0.728 | 9 | 48 | 3.8 | 2.7 | ○ | Comparative Example |
| 46 | 993 | 21.4 | 13.3 | 8.1 | 21250 | 702 | 0.707 | 26 | 55 | 2.5 | 1.8 | ○ | Example |
| 47 | 991 | 24.9 | 17.0 | 7.9 | 24676 | 694 | 0.700 | 26 | 60 | 2.6 | 1.6 | ○ | Example |
| 48 | 1034 | 24.6 | 17.2 | 7.4 | 25436 | 725 | 0.701 | 25 | 59 | 3.6 | 2.0 | ○ | Example |
| 49 | 1097 | 22.3 | 16.0 | 6.3 | 24463 | 769 | 0.701 | 21 | 44 | 2.8 | 1.8 | ○ | Example |
| 50 | 1211 | 15.1 | 10.9 | 4.2 | 18286 | 862 | 0.712 | 18 | 39 | 2.0 | 1.4 | ○ | Example |
| 51 | 1001 | 27.1 | 19.8 | 7.3 | 27127 | 723 | 0.722 | 25 | 53 | 2.0 | 1.4 | ○ | Example |
| 52 | 981 | 23.4 | 16.7 | 6.7 | 22955 | 709 | 0.723 | 25 | 54 | 2.0 | 1.7 | ○ | Example |

TABLE 6-continued

| No | TS (MPa) | EL (%) | U. EL (%) | L. EL (%) | TS × EL (MPa · %) | YS (MPa) | YR | λ (Punching) (%) | λ (Reaming) (%) | R (mm) | R/t | Coatability | Note |
|---|---|---|---|---|---|---|---|---|---|---|---|---|---|
| 53 | 1019 | 21.3 | 15.5 | 5.8 | 21705 | 744 | 0.730 | 21 | 52 | 2.0 | 1.7 | ○ | Example |
| 54 | 992 | 24.3 | 18.2 | 6.1 | 24106 | 739 | 0.745 | 23 | 54 | 2.0 | 1.4 | ○ | Example |
| 55 | 981 | 21.1 | 14.4 | 6.7 | 20699 | 721 | 0.735 | 25 | 45 | 2.0 | 1.7 | ○ | Example |
| 56 | 981 | 22.3 | 15.8 | 6.5 | 21876 | 720 | 0.734 | 24 | 49 | 2.2 | 1.6 | ○ | Example |
| 57 | 1035 | 20.5 | 14.1 | 6.4 | 21218 | 733 | 0.708 | 23 | 42 | 2.4 | 1.7 | ○ | Example |
| 58 | 998 | 23.0 | 16.5 | 6.5 | 22954 | 705 | 0.706 | 25 | 54 | 2.5 | 1.8 | ○ | Example |
| 59 | 1012 | 22.9 | 16.6 | 6.3 | 23175 | 721 | 0.712 | 23 | 51 | 2.4 | 2.0 | ○ | Example |
| 60 | 1083 | 18.1 | 12.1 | 6.0 | 19602 | 768 | 0.709 | 21 | 43 | 2.0 | 1.3 | ○ | Example |
| 61 | 985 | 25.4 | 18.3 | 7.1 | 25019 | 718 | 0.729 | 27 | 51 | 2.0 | 1.4 | ○ | Example |
| 62 | 1062 | 23.0 | 16.8 | 6.2 | 24426 | 746 | 0.702 | 22 | 50 | 2.2 | 1.6 | ○ | Example |

Underlined portion: out of the range of the present invention.

A tensile test was performed on a JIS No. 5 test piece which had been taken so that the tensile direction was a direction perpendicular to the rolling direction of the steel sheet in accordance with JIS Z 2241 (2011) to determine TS (tensile strength), EL (total elongation), U.EL (uniform elongation), L.EL (local elongation), YS (yield stress), and YR (yield ratio). Here, "YR" denotes a value calculated by dividing YS by TS.

With regard to mechanical properties in accordance with aspects of the present invention, the following cases with a YR of 0.7 or more are judged as good.

EL: 20% or more and L.EL: 5 or more in the case of TS: 980 MPa or more and less than 1080 MPa EL: 16% or more and L.EL: 4 or more in the case of TS: 1080 MPa or more and less than 1180 MPa EL: 12% or more and L.EL: 3 or more in the case of TS: 1180 MPa or more and less than 1270 MPa Here, the thickness was 1.0 mm to 1.8 mm.

A hole expanding test was performed in accordance with JIS Z 2256 (2010). Each of the obtained steel sheets was cut into a piece having a size of 100 mm×100 mm, a hole having a diameter of 10 mm was made in the cut piece by using a punching method with a clearance of 12%±1% or a reaming method for enlarging a hole to a diameter of 10 mm, and the hole was expanded by pushing a conical punch having a point angle of 60° into the hole while the cut piece was held with a blank holding force of 9 tons on a die having an inner diameter of 75 mm to determine the diameter of the expanded hole for a crack generation limit, the limiting hole expanding ratio λ (%) was calculated by using the formula below, and stretch flangeability was evaluated on the basis of the limiting hole expanding ratio.

Here, the term "reaming" denotes a process in which a drilled hole is enlarged by using the cutting edges of a reamer so that the hole has a predetermined diameter, and the cut surface is then finished by using the margin of the reamer so that the cut surface is smoothened.

$$\text{limiting hole expanding ratio } \lambda\ (\%)=\{(D_f-D_0)/D_0\}\times 100$$

Here, $D_f$ denotes the diameter (mm) of the hole when a crack is generated, and $D_0$ denotes the initial diameter (mm) of the hole. Here, in accordance with aspects of the present invention, the following cases are judged as good depending on TS.

(punching) λ: 15% or more or (reaming) λ: 40% or more in the case of TS: 980 MPa or more and less than 1080 MPa (punching) λ: 12% or more or (reaming) λ: 35% or more in the case of TS: 1080 MPa or more and less than 1180 MPa (punching) λ: 10% or more or (reaming) λ: 30% or more in the case of TS: 1180 MPa or more and less than 1270 MPa A bending test was performed on a bending test piece having a width of 30 mm and a length of 100 mm which had been taken from each of the annealed steel sheets so that the rolling direction was the bending direction in accordance with the V-block method prescribed in JIS Z 2248 (1996). The test was performed with a pushing speed of 100 mm/s three times each for respective one of the bending radii, the outer side of the bending position was observed by using a stereoscopic microscope to judge whether or not a crack was generated, and the limiting bending radius R (mm) was defined as the minimum radius with which no crack was generated. Here, in accordance with aspects of the present invention, a case where (limiting bending radius R)/t (t: steel sheet thickness (mm)) was 2.5 or less in a 90° V-bend was judged as a case of a steel sheet having good bendability.

Coatability was evaluated by performing visual test. A case where an appropriate surface quality is achieved without any poor appearance such as bare spot, a variation in alloying degree, and other defects causing deterioration in surface quality was judged as "○", a case of an excellent surface quality without a variation in color tone or the like was judged as "⊙", a case where a partial minor defect was found was judged as "Δ", and a case where many surface defects were found was judged as "x".

All of the high-strength galvanized steel sheets of the examples of the present invention had a TS of 980 MPa or more and excellent formability. On the other hand, the comparative examples were poor in terms of at least one of YR, TS, EL, L.EL, λ, bendability, and coatability.

INDUSTRIAL APPLICABILITY

According to aspects of the present invention, it is possible to obtain a high-strength galvanized steel sheet having a TS (tensile strength) of 980 MPa or more and excellent formability. By using the high-strength galvanized steel sheet according to aspects of the present invention for, for example, automobile structural members, it is possible to improve fuel efficiency due to a decrease in weight of automobile bodies, which has a significant utility value in the industry.

The invention claimed is:

1. A high-strength galvanized steel sheet having a chemical composition containing, by mass %, C: 0.030% to 0.250%, Si: 0.01% to 3.00%, Mn: 3.10% to 8.00%, P: 0.001% to 0.100%,
S: 0.0001% to 0.0200%,
N: 0.0005% to 0.0100%,
Al: 0.001% to 2.000%, and a balance of Fe and incidental impurities, a steel microstructure including, in terms of area fraction, 35% or more and 80% or less of ferrite, 0.1% or more and less than 5.0% of as-quenched martensite, 3.0% or more and 35% or less of tempered martensite, and 8% or more of retained austenite, in which an average grain diameter of the ferrite is 6 μm or less, in which an average grain diameter of the retained austenite is 3 μm or less, in which a value calculated by dividing an average Mn content (mass %) in the retained austenite by an average Mn content (mass %) in the ferrite is 1.5 or more, in which a value calculated by dividing a sum of an area fraction of tempered martensite having a circle-equivalent grain diameter of 3 μm or less and an area fraction of retained austenite having a circle-equivalent grain diameter of 3 μm or less by a sum of an area fraction of all the tempered martensite and an area fraction of all the retained austenite is 0.4 or more, and in which a value calculated by dividing an area fraction of retained austenite grains adjacent to three or more ferrite grains having different crystal orientations by the area fraction of all the retained austenite is less than 0.6, a galvanizing layer on a surface of the steel sheet, and a diffusible hydrogen content in steel of 0.3 mass ppm or less.

2. The high-strength galvanized steel sheet according to claim 1, wherein the chemical composition further contains, by mass %, at least one selected from Ti: 0.005% to 0.200%,
Nb: 0.005% to 0.200%,
V: 0.005% to 0.500%,
W: 0.005% to 0.500%,
B: 0.0003% to 0.0050%,
Ni: 0.005% to 1.000%,
Cr: 0.005% to 1.000%,
Mo: 0.005% to 1.000%,
Cu: 0.005% to 1.000%,
Sn: 0.002% to 0.200%,
Sb: 0.002% to 0.200%,
Ta: 0.001% to 0.100%,
Ca: 0.0005% to 0.0050%,
Mg: 0.0005% to 0.0050%,
Zr: 0.0005% to 0.0050%, and
REM: 0.0005% to 0.0050%.

3. The high-strength galvanized steel sheet according to claim 1, wherein the galvanizing layer is a galvannealing layer.

4. The high-strength galvanized steel sheet according to claim 2, wherein the galvanizing layer is a galvannealing layer.

5. A method for manufacturing the high-strength galvanized steel sheet according to claim 1, the method comprising heating a steel slab having the chemical composition, performing hot rolling on the heated slab with a finishing delivery temperature of 750° C. or higher and 1000° C. or lower, coiling the hot-rolled steel sheet at a temperature of 300° C. or higher and 750° C. or lower, performing cold rolling on the hot-rolled steel sheet, holding the cold-rolled steel sheet in a temperature range equal to or higher than an Aca transformation temperature for 20 s to 1800 s, cooling the held steel sheet to a cooling stop temperature of 50° C. or higher and 350° C. or lower, holding the cooled steel sheet at the cooling stop temperature for 2 s to 600 s, cooling the held steel sheet, holding the cooled steel sheet in a temperature range equal to or higher than an $Ac_1$ transformation temperature and equal to or lower than ($Ac_1$ transformation temperature+150° C.) for 20 s to 1800 s, cooling the held steel sheet, performing a galvanizing treatment, holding the galvanized steel sheet in a temperature range of 50° C. or higher and 400° C. or lower for 1800 s or more, and cooling the held steel sheet.

6. A method for manufacturing the high-strength galvanized steel sheet according to claim 2, the method comprising heating a steel slab having the chemical composition, performing hot rolling on the heated slab with a finishing delivery temperature of 750° C. or higher and 1000° C. or lower, coiling the hot-rolled steel sheet at a temperature of 300° C. or higher and 750° C. or lower, performing cold rolling on the hot-rolled steel sheet, holding the cold-rolled steel sheet in a temperature range equal to or higher than an Aca transformation temperature for 20 s to 1800 s, cooling the held steel sheet to a cooling stop temperature of 50° C. or higher and 350° C. or lower, holding the cooled steel sheet at the cooling stop temperature for 2 s to 600 s, cooling the held steel sheet, holding the cooled steel sheet in a temperature range equal to or higher than an $Ac_1$ transformation temperature and equal to or lower than ($Ac_1$ transformation temperature+150° C.) for 20 s to 1800 s, cooling the held steel sheet, performing a galvanizing treatment, holding the galvanized steel sheet in a temperature range of 50° C. or higher and 400° C. or lower for 1800 s or more, and cooling the held steel sheet.

7. A method for manufacturing the high-strength galvanized steel sheet according to claim 1, the method comprising heating a steel slab having the chemical composition, performing hot rolling on the heated slab with a finishing delivery temperature of 750° C. or higher and 1000° C. or lower, coiling the hot-rolled steel sheet at a temperature of 300° C. or higher and 750° C. or lower, performing cold rolling on the hot-rolled steel sheet, holding the cold-rolled steel sheet in a temperature range equal to or higher than an Aca transformation temperature for 20 s to 1800 s, cooling the held steel sheet to a cooling stop temperature of 50° C. or higher and 350° C. or lower, holding the cooled steel sheet at the cooling stop temperature for 2 s to 600 s, cooling the held steel sheet, holding the cooled steel sheet in a temperature range equal to or higher than an $Ac_1$ transformation temperature and equal to or lower than ($Ac_1$ transformation temperature+150° C.) for 20 s to 1800 s, cooling the held steel sheet, again holding the cooled steel sheet in a temperature range equal to or higher than the $Ac_1$ transformation temperature and equal to or lower than ($Ac_1$ transformation temperature+150° C.) for 20 s to 1800 s, cooling the held steel sheet, performing a galvanizing treatment, holding the galvanized steel sheet in a temperature range of 50° C. or higher and 400° C. or lower for 1800 s or more, and cooling the held steel sheet.

8. A method for manufacturing the high-strength galvanized steel sheet according to claim 2, the method comprising heating a steel slab having the chemical composition, performing hot rolling on the heated slab with a finishing delivery temperature of 750° C. or higher and 1000° C. or lower, coiling the hot-rolled steel sheet at a temperature of 300° C. or higher and 750° C. or lower, performing cold rolling on the hot-rolled steel sheet, holding the cold-rolled steel sheet in a temperature range equal to or higher than an Aca transformation temperature for 20 s to 1800 s, cooling the held steel sheet to a cooling stop temperature of 50° C. or higher and 350° C. or lower, holding the cooled steel sheet at the cooling stop temperature for 2 s to 600 s, cooling the held steel sheet, holding the cooled steel sheet in a temperature range equal to or higher than an $Ac_1$ transformation temperature and equal to or lower than ($Ac_1$ transformation temperature+150° C.) for 20 s to 1800 s, cooling the held steel sheet, again holding the cooled steel sheet in a temperature range equal to or higher than the $Ac_1$ transformation temperature and equal to or lower than ($Ac_1$ transformation temperature+150° C.) for 20 s to 1800 s, cooling the held steel sheet, performing a galvanizing treatment, holding the galvanized steel sheet in a temperature range of 50° C. or higher and 400° C. or lower for 1800 s or more, and cooling the held steel sheet.

9. The method for manufacturing a high-strength galvanized steel sheet according to claim 5, the method further comprising, after coiling has been performed, holding the steel sheet in a temperature range equal to or lower than the $Ac_1$ transformation temperature for more than 1800 s.

10. The method for manufacturing a high-strength galvanized steel sheet according to claim 6, the method further comprising, after coiling has been performed, holding the steel sheet in a temperature range equal to or lower than the $Ac_1$ transformation temperature for more than 1800 s.

11. The method for manufacturing a high-strength galvanized steel sheet according to claim 7, the method further comprising, after coiling has been performed, holding the steel sheet in a temperature range equal to or lower than the $Ac_1$ transformation temperature for more than 1800 s.

12. The method for manufacturing a high-strength galvanized steel sheet according to claim 8, the method further comprising, after coiling has been performed, holding the steel sheet in a temperature range equal to or lower than the $Ac_1$ transformation temperature for more than 1800 s.

13. The method for manufacturing a high-strength galvanized steel sheet according to claim 5, the method further comprising, after the galvanizing treatment has been performed, performing an alloying treatment at a temperature of 450° C. to 600° C.

14. The method for manufacturing a high-strength galvanized steel sheet according to claim 6, the method further comprising, after the galvanizing treatment has been performed, performing an alloying treatment at a temperature of 450° C. to 600° C.

15. The method for manufacturing a high-strength galvanized steel sheet according to claim 7, the method further comprising, after the galvanizing treatment has been performed, performing an alloying treatment at a temperature of 450° C. to 600° C.

16. The method for manufacturing a high-strength galvanized steel sheet according to claim 8, the method further comprising, after the galvanizing treatment has been performed, performing an alloying treatment at a temperature of 450° C. to 600° C.

17. The method for manufacturing a high-strength galvanized steel sheet according to claim 9, the method further comprising, after the galvanizing treatment has been performed, performing an alloying treatment at a temperature of 450° C. to 600° C.

18. The method for manufacturing a high-strength galvanized steel sheet according to claim 10, the method further comprising, after the galvanizing treatment has been performed, performing an alloying treatment at a temperature of 450° C. to 600° C.

19. The method for manufacturing a high-strength galvanized steel sheet according to claim 11, the method further comprising, after the galvanizing treatment has been performed, performing an alloying treatment at a temperature of 450° C. to 600° C.

20. The method for manufacturing a high-strength galvanized steel sheet according to claim 12, the method further comprising, after the galvanizing treatment has been performed, performing an alloying treatment at a temperature of 450° C. to 600° C.

* * * * *